US011668270B2

(12) United States Patent
Zuehl et al.

(10) Patent No.: US 11,668,270 B2
(45) Date of Patent: Jun. 6, 2023

(54) ELECTRONIC FUEL INJECTION MODULE

(71) Applicant: Briggs & Stratton, LLC, Wauwatosa, WI (US)

(72) Inventors: Jacob Zuehl, Hartland, WI (US); Michael Pitcel, Waukesha, WI (US); Kevin Leix, Wauwatosa, WI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 0 days.

(21) Appl. No.: 17/284,056

(22) PCT Filed: Oct. 11, 2019

(86) PCT No.: PCT/US2019/055791
§ 371 (c)(1),
(2) Date: Apr. 9, 2021

(87) PCT Pub. No.: WO2020/077181
PCT Pub. Date: Apr. 16, 2020

(65) Prior Publication Data

US 2021/0404428 A1 Dec. 30, 2021

Related U.S. Application Data

(60) Provisional application No. 62/744,765, filed on Oct. 12, 2018.

(51) Int. Cl.
*F02M 51/04* (2006.01)
*F02M 37/00* (2006.01)
(Continued)

(52) U.S. Cl.
CPC ..... *F02M 51/04* (2013.01); *F02M 37/0047* (2013.01); *F02M 37/08* (2013.01);
(Continued)

(58) Field of Classification Search
CPC .. F02M 37/0047; F02M 37/007; F02M 37/08; F02M 37/14; F02M 37/20;
(Continued)

(56) References Cited

U.S. PATENT DOCUMENTS 3,293,516 A 12/1966 Maier et al.
4,116,591 A 9/1978 Mardell
(Continued)

FOREIGN PATENT DOCUMENTS

CN 103119297 A 5/2013
CN 104956064 A 9/2015
(Continued)

*Primary Examiner* — John M Zaleskas
(74) *Attorney, Agent, or Firm* — Foley & Lardner LLP

(57) ABSTRACT

One embodiment of the invention relates to an electronic fuel injection module including a throttle body including a throat extending between an inlet port and an outlet port and a fuel delivery injector too unit. The fuel delivery injector unit includes a cavity, a fuel inlet, a magnetic assembly, a pumping assembly, a spring, a valve seat, a valve, and an out valve. The fuel inlet receives fuel and directs fuel into the cavity. The magnetic assembly is within the cavity and includes a magnet, a pole, and a hollow sleeve. The pumping assembly includes a bobbin and piston. The bobbin is configured to move the pumping assembly. The piston is coupled to the bobbin. The valve seat is located at one end of the piston. The valve selectively allows fuel to flow into a pressure chamber. The out valve is configured to provide fuel to the throat.

15 Claims, 19 Drawing Sheets

(51) Int. Cl.

| | |
|---|---|
| ***F02M 37/08*** | (2006.01) |
| ***F02M 37/14*** | (2006.01) |
| ***F02M 37/20*** | (2006.01) |
| ***F02M 57/02*** | (2006.01) |
| ***F02M 61/08*** | (2006.01) |

(52) U.S. Cl.
CPC ..... *F02M 37/14* (2013.01); *F02M 37/20* (2013.01); *F02M 57/02* (2013.01); *F02M 57/027* (2013.01); *F02M 61/08* (2013.01); *F02M 2200/50* (2013.01)

(58) Field of Classification Search
CPC ..... F02M 51/04; F02M 57/02; F02M 57/027; F02M 61/02; F02M 61/08; F02M 61/145; F02M 69/04; F02M 69/043; F02M 2200/50
See application file for complete search history.

(56) References Cited

U.S. PATENT DOCUMENTS 4,121,125 A 10/1978 Dolz
4,327,695 A 5/1982 Schechter
4,410,302 A 10/1983 Chiba et al.
4,463,900 A 8/1984 Wich
4,505,243 A 3/1985 Miwa
4,552,311 A 11/1985 Casey
4,699,110 A 10/1987 Iwano et al.
4,756,291 A 7/1988 Cummins et al.
4,915,602 A 4/1990 Tschopp
5,019,119 A 5/1991 Hare, Sr.
5,094,212 A * 3/1992 Kawaguchi ..... F02M 69/46 123/41.31
5,107,890 A 4/1992 Gute
5,351,893 A 10/1994 Young
5,390,257 A 2/1995 Oslac et al.
5,419,492 A 5/1995 Gant et al.
5,469,828 A 11/1995 Heimberg et al.
5,472,323 A 12/1995 Hirabayashi et al.
5,511,955 A 4/1996 Brown et al.
5,630,401 A * 5/1997 Binversie ..... F02M 59/462 123/495
5,704,771 A 1/1998 Fujisawa et al.
5,781,363 A 7/1998 Rowan et al.
5,898,786 A 4/1999 Geisenberger
6,024,071 A 2/2000 Heimberg et al.
6,081,112 A 6/2000 Carobolante et al.
6,135,357 A 10/2000 Herrin et al.
6,203,288 B1 3/2001 Kottke
6,290,308 B1 9/2001 Zitzelsberger
6,298,829 B1 10/2001 Welch et al.
6,373,957 B1 4/2002 Stewart
6,378,792 B2 4/2002 Fukaya et al.
6,394,367 B2 5/2002 Munezane et al.
6,422,836 B1 * 7/2002 Krueger ..... F02M 55/00 310/314
6,614,617 B1 9/2003 Galloway
6,640,787 B2 11/2003 Hashimoto et al.
6,685,114 B2 2/2004 Okamoto et al.
6,776,143 B2 8/2004 Goodenough et al.
6,796,290 B2 9/2004 Boehland et al.
6,877,489 B2 4/2005 Hashimoto et al.
6,877,679 B2 4/2005 Lawes
6,923,163 B2 8/2005 Yamazaki
6,964,263 B2 11/2005 Xi et al.
6,966,760 B1 11/2005 Radue
7,063,520 B2 6/2006 Oh et al.
7,100,578 B2 9/2006 Yamazaki et al.
7,150,606 B2 12/2006 Bonfardeci et al.
7,225,790 B2 6/2007 Bartunek et al.
7,267,533 B1 9/2007 Tocci et al.
7,287,966 B2 10/2007 French et al.
7,309,025 B2 12/2007 Yamazaki et al.
7,377,266 B2 5/2008 Xi et al.
7,410,347 B2 8/2008 Radue
7,438,050 B2 10/2008 Allen
7,484,673 B2 2/2009 Boecking
7,533,655 B2 5/2009 Allen
7,753,657 B2 7/2010 Strauss et al.
7,798,130 B2 9/2010 Allen
7,866,144 B2 1/2011 Bakaj et al.
8,079,825 B2 12/2011 Bocchiola
8,225,770 B2 7/2012 Ohta et al.
8,657,586 B2 2/2014 Achor
9,500,170 B2 11/2016 Nong
10,197,025 B2 2/2019 Pitcel et al.
10,330,061 B2 6/2019 Nong
10,619,628 B2 4/2020 Plisch et al.
10,859,073 B2 12/2020 Nong
2001/0007249 A1 * 7/2001 Ishikawa ..... F02M 59/14 123/73 AF
2003/0116135 A1 * 6/2003 Hashimoto ..... F02M 57/027 123/446
2003/0155444 A1 * 8/2003 Lawes ..... F02D 41/40 239/585.1
2004/0020475 A1 * 2/2004 Hashimoto ..... F02M 61/08 123/514
2004/0065304 A1 * 4/2004 Xi ..... F02M 51/04 123/497
2004/0182368 A1 * 9/2004 Hashimoto ..... F02M 55/007 123/516
2005/0045155 A1 3/2005 Harvey et al.
2005/0053470 A1 * 3/2005 Yamazaki ..... F02M 69/08 417/44.11
2005/0056261 A1 * 3/2005 Marchesini ..... F02D 11/10 123/480
2005/0263135 A1 12/2005 Magel et al.
2006/0011735 A1 1/2006 Magel
2006/0070941 A1 4/2006 Cline et al.
2006/0097067 A1 5/2006 Buehler et al.
2006/0169248 A1 * 8/2006 Chida ..... F02D 9/105 123/399
2007/0028899 A1 * 2/2007 Allen ..... F02D 41/345 123/494
2007/0095934 A1 5/2007 Wisdom
2007/0113829 A1 * 5/2007 Allen ..... F02M 63/0026 123/492
2007/0256667 A1 * 11/2007 Xi ..... F02M 57/027 123/467
2008/0202465 A1 * 8/2008 Allen ..... F02M 51/04 123/196 R
2008/0223337 A1 * 9/2008 Murakami ..... F02D 11/10 123/399
2009/0018750 A1 * 1/2009 Kadam ..... F02M 69/465 701/103
2009/0071448 A1 3/2009 Smith et al.
2009/0108093 A1 4/2009 Mattes et al.
2009/0217911 A1 9/2009 Yokura et al.
2009/0293845 A1 * 12/2009 Matsuda ..... F02D 9/105 123/462
2010/0011578 A1 1/2010 Beck et al.
2010/0024775 A1 * 2/2010 Takahashi ..... F02M 37/007 123/445
2010/0047090 A1 2/2010 Marx et al.
2010/0077993 A1 * 4/2010 Satterfield ..... F02M 69/043 123/439
2010/0145595 A1 * 6/2010 Bellistri ..... F02M 69/462 123/185.2
2010/0193611 A1 8/2010 Burger et al.
2010/0212635 A1 * 8/2010 Allen ..... F02M 35/10032 123/445
2010/0236526 A1 9/2010 Wang et al.
2010/0300407 A1 * 12/2010 Ravenhill ..... F02M 35/10144 123/468
2010/0312453 A1 * 12/2010 Smither ..... F02M 69/002 73/29.01
2011/0213543 A1 * 9/2011 Bellistri ..... F02D 31/002 701/103
2012/0244022 A1 9/2012 Nakai et al.
2013/0054121 A1 * 2/2013 Casoni ..... F02M 35/162 29/888.011

(56) References Cited

U.S. PATENT DOCUMENTS

| | | | | |
|---|---|---|---|---|
| 2013/0270370 | A1 | 10/2013 | Kondo et al. | |
| 2013/0298871 | A1 | 11/2013 | Bennett et al. | |
| 2014/0117121 | A1* | 5/2014 | Nong | F02M 51/08 239/584 |
| 2014/0137839 | A1 | 5/2014 | Russ | |
| 2014/0373806 | A1 | 12/2014 | Hou | |
| 2016/0017873 | A1 | 1/2016 | Byun et al. | |
| 2016/0186732 | A1 | 6/2016 | Xi et al. | |
| 2017/0067429 | A1 | 3/2017 | Nong | |
| 2017/0268469 | A1 | 9/2017 | Plisch et al. | |
| 2018/0030969 | A1* | 2/2018 | Nong | F04B 53/14 |
| 2018/0252191 | A1* | 9/2018 | Pitcel | F04B 17/03 |
| 2018/0283332 | A1* | 10/2018 | Nong | F02M 69/02 |
| 2019/0120193 | A1* | 4/2019 | Burns | F02M 69/044 |
| 2019/0136808 | A1* | 5/2019 | Pitcel | F04B 17/046 |
| 2019/0178212 | A1 | 6/2019 | Hanby et al. | |
| 2019/0195377 | A1 | 6/2019 | Fisch et al. | |
| 2019/0285036 | A1 | 9/2019 | Nong | |
| 2020/0124010 | A1* | 4/2020 | Abei | F02D 9/1035 |
| 2020/0256295 | A1* | 8/2020 | Pitcel | F04B 49/06 |
| 2021/0003099 | A1* | 1/2021 | Burns | F02D 41/0002 |

FOREIGN PATENT DOCUMENTS

| | | | | |
|---|---|---|---|---|
| DE | 10 2008 005 647 | A1 | 7/2009 | |
| DE | 102008004634 | A1 * | 7/2009 | F02M 51/04 |
| DE | 102009000343 | A1 * | 7/2010 | F02M 37/14 |
| DE | 102009029266 | A1 * | 3/2011 | F02M 37/20 |
| EP | 0 570 649 | B1 | 11/1993 | |
| EP | 0 752 148 | | 1/1997 | |
| EP | 1 248 494 | | 10/2002 | |
| EP | 1 249 598 | A2 | 10/2002 | |
| EP | 1 367 225 | | 12/2003 | |
| EP | 1 832 739 | A1 | 9/2007 | |
| EP | 2 198 140 | | 6/2010 | |
| GB | 2 452 955 | B | 3/2009 | |
| WO | WO-2011/095622 | A1 | 8/2011 | |
| WO | WO-2014/066696 | A1 | 5/2014 | |

* cited by examiner

ELECTRONIC FUEL INJECTION MODULE

CROSS-REFERENCE TO RELATED APPLICATIONS

The present application is a National Stage Application of International Application No. PCT/US2019/055791, filed Oct. 11, 2019, and claims the benefit of and priority to U.S. Provisional Patent Application No. 62/744,765 filed Oct. 12, 2018, the contents of which are hereby incorporated by reference in their entireties.

BACKGROUND

The present disclosure general relates to the field of electronic fuel injection systems, and more particularly to the field of electronic fuel injection systems for small air-cooled engines.

SUMMARY

One embodiment of the invention relates to an electronic fuel injection module. The electronic fuel injection module includes a throttle body. The throttle body includes a throat extending between an inlet port and an outlet port and a fuel delivery injector unit. The fuel delivery injector unit includes a cavity extending along a central longitudinal axis, a fuel inlet, a magnetic assembly, a pumping assembly, a spring, a valve seat, a valve, and an out valve. The fuel inlet is configured to receive fuel and is fluidly coupled to the cavity to direct fuel into the cavity. The magnetic assembly is fixedly positioned within the cavity and includes a magnet, a pole, and a hollow sleeve. The magnet and the pole are secured to the sleeve. The pumping assembly includes a bobbin and piston. The bobbin includes a coil configured to be coupled to an electrical power supply and is configured to move the pumping assembly within the cavity in response to an interaction between a magnetic field created by energizing the coil and the magnetic assembly. The piston is coupled to the bobbin and configured to move within the sleeve. The spring is coupled to pumping assembly to bias the pumping assembly to a home position. The valve seat is located at one end of the piston. The valve is configured to selectively engage the valve seat in response to movement of the piston within the sleeve and allows fuel to flow into a pressure chamber when open and prevents fuel flow into the pressure chamber when closed. The out valve is positioned between the pressure chamber and the outlet passage and allows fuel to flow from the pressure chamber into the outlet passage when open, prevents fuel flow from the pressure chamber into the outlet passage when closed, is in fluid communication with the throat, and is configured to provide fuel to the throat.

In some embodiments, the throttle body further includes a frame defining a cavity and a cover coupled to the frame and including the fuel inlet. Wherein, with the fuel delivery in a normal operating position, the fuel inlet is located near a bottom portion of the delivery injector unit and the outlet passage is located near a top portion of the fuel delivery injector In some embodiments, the throat is defined in a throttle body housing and the frame of the fuel delivery injector is integrally formed within the throttle body housing to form a single unitary component.

In some embodiments, the electronic fuel injection module further includes an electronic controller configured to control operation the fuel delivery injector unit and the throttle body further includes a circuitry compartment in which the electronic controller is located.

In some embodiments, the electronic fuel injection module further includes a vent passage in fluid communication with the cavity. The vent passage configured to vent fuel vapor and/or air from the fuel delivery injector unit.

In some embodiments, the electronic fuel injection module further includes a power supply. Further, the spring is electrically coupled to the coil and the power supply and is configured to conduct an electrical current from the power supply to the coil.

In some embodiments, the spring is one of a plurality of springs, in which each spring is coupled to the pumping assembly to bias the pumping assembly to a home position. Each spring electrically coupled to the coil and the power supply and configured to conduct an electrical current from the power supply to the coil.

Another embodiment of the invention relates to a small air-cooled engine. The small air-cooled engine includes a cylinder, a piston, a crankshaft, a fuel tank, an air clean, and an electronic fuel injector module. The cylinder includes a cylinder head and a cylinder intake port. The piston is configured to reciprocate within the cylinder. The crankshaft is configured to rotate in response to the reciprocation of the piston. The fuel tank is configured to store liquid fuel. The air cleaner is configured to filter air for combustion. The electronic fuel injector module includes a throat and a fuel delivery injector unit. The throat extends between an inlet port and an outlet port. The inlet port is fluidly coupled to the air cleaner to receive filtered air. The fuel delivery injector unit has a fuel inlet and outlet passage. The fuel inlet is fluidly coupled to the fuel tank and is positioned below the fuel tank so that liquid fuel is delivered to the fuel inlet via gravity. The outlet passage is fluidly coupled to the throat to provide fuel to mix with the filtered air. The outlet port is fluidly coupled to the cylinder intake port to provide a fuel-air mixture for combustion in the cylinder.

In some embodiments, the electronic fuel injector module includes a throttle body including an outlet. Further, the throat is formed in the throttle body and the outlet port is formed in the outlet.

In some embodiments, the fuel delivery injector unit is a separate component from the throttle body.

In some embodiments, the outlet of the throttle body is directly coupled to the cylinder head to fluidly couple the outlet port to the cylinder intake port.

In some embodiments, the small air-cooled engine further includes a fitting. The outlet of the throttle body coupled to the cylinder head by the fitting to fluidly couple the outlet port the cylinder intake port.

In some embodiments, the small air-cooled engine does not include a fuel pump.

In some embodiments, the electronic fuel injector module is an electronic fuel injector module as specified in the first embodiment of the invention.

Yet another embodiment of the invention relates to a small air-cooled engine. The small air-cooled engine includes a cylinder, a piston, a crankshaft, a fuel tank, an air clean, and an electronic fuel injector module. The cylinder includes a cylinder head and a cylinder intake port. The piston is configured to reciprocate within the cylinder. The crankshaft is configured to rotate in response to the reciprocation of the piston. The fuel tank is configured to store liquid fuel. The air cleaner is configured to filter air for combustion. The electronic fuel injector module includes a throttle body and a fuel delivery injector unit. The throttle body includes an outlet and a throat extending between an inlet port and an outlet port. The inlet port is fluidly coupled to the air cleaner to receive filtered air. The outlet port is formed in the outlet. The fuel delivery injector unit has a fuel inlet and outlet passage. The fuel inlet is fluidly coupled to the fuel tank to receive liquid fuel. The outlet passage is fluidly coupled to the throat to provide fuel to mix with the filtered air. The outlet port is fluidly coupled to the cylinder intake port to provide a fuel-air mixture for combustion in the cylinder.

In some embodiments, the outlet of the throttle body is directly coupled to the cylinder head to fluidly couple the outlet port to the cylinder intake port.

In some embodiments, the small air-cooled engine further includes a fitting. The outlet of the throttle body is coupled to the cylinder head by the fitting to fluidly couple the outlet port to the intake port.

In some embodiments, the small air-cooled engine does not include a fuel pump.

In some embodiments, the electronic fuel injector module is an electronic fuel injector module as specified in the first embodiment of the invention.

Yet another embodiment of the invention relates to an electronic fuel injector module for use with an engine. The electronic fuel injector module includes a throttle body, a fuel delivery injector unit, and a power supply. The electronic fuel injector module is configured to use an average electrical current of less than 1 Amp during operation of the engine.

In some embodiments, the electronic fuel injector module is configured to use an average electrical current of 1.5 Amps during an injection event of the fuel delivery injector unit.

In some embodiments, the fuel delivery injection unit includes a cavity extending along a central longitudinal axis, a fuel inlet, a magnetic assembly, a pumping assembly, a spring, a valve seat, a valve, and an out valve. The fuel inlet is configured to receive fuel and is fluidly coupled to the cavity to direct fuel into the cavity. The magnetic assembly is fixedly positioned within the cavity and includes a magnet, a pole, and a hollow sleeve. The magnet and the pole are secured to the sleeve. The pumping assembly includes a bobbin and piston. The bobbin includes a coil configured to be coupled to an electrical power supply and is configured to move the pumping assembly within the cavity in response to an interaction between a magnetic field created by energizing the coil and the magnetic assembly. The piston is coupled to the bobbin and configured to move within the sleeve. The spring is coupled to pumping assembly to bias the pumping assembly to a home position. The valve seat is located at one end of the piston. The valve is configured to selectively engage the valve seat in response to movement of the piston within the sleeve and allows fuel to flow into a pressure chamber when open and prevents fuel flow into the pressure chamber when closed. The out valve is positioned between the pressure chamber and the outlet passage and allows fuel to flow from the pressure chamber into the outlet passage when open, prevents fuel flow from the pressure chamber into the outlet passage when closed, is in fluid communication with the throat, and is configured to provide fuel to the throat.

In some embodiments, the valve is configured to selectively engage the valve seat in response to movement of the piston within the sleeve, the movement of the piston being toward the magnetic assembly.

Yet another embodiment of the invention relates to a fuel delivery injector unit. The fuel delivery injector unit includes a frame extending along a central longitudinal axis and defining a cavity, a fuel inlet, a magnetic assembly, a pumping assembly, a valve seat, a valve, and an out valve. The fuel inlet is configured to receive fuel and is fluidly coupled to the cavity to direct fuel into the cavity. The magnetic assembly is fixedly positioned within the cavity and includes a magnet, a pole, and a hollow sleeve. The magnet and the pole are secured to the sleeve. The pumping assembly includes a bobbin and a piston. The bobbin includes a coil configured to be coupled to an electrical power supply and is configured to move the pumping assembly within the cavity in response to interaction between a magnetic field created by energizing the coil and the magnetic assembly. The piston is coupled to the bobbin, is configured to move within the sleeve, and is located within a periphery of the magnetic assembly. The valve seat is located at one end of the piston. The valve is configured to selectively engage the valve seat in response to movement of the piston within the sleeve and allows the fuel to flow into a pressure chamber when open and prevents fuel flow into the pressure chamber when closed. The out valve is positioned between the pressure chamber and an outlet passage. The out valve allows fuel to flow from the pressure chamber into the outlet passage when open and prevents fuel flow from the pressure chamber into the outlet passage when closed. The outlet passage is in fluid communication with a throat and is configured to provide fuel to the throat.

In some embodiments, the piston, the sleeve, and the valve are made of a non-magnetic material.

In some embodiments, the bobbin and the piston are a single integral piece.

Yet another embodiment of the invention relates to a small air-cooled engine. The small air-cooled engine includes two cylinders, two pistons, a crankshaft, a fuel tank, an air cleaner, a throttle body, an intake manifold, and two electronic fuel injector modules. Each cylinder includes a cylinder head and a cylinder intake port. Each piston is configured to reciprocate within one of the cylinders. The crankshaft is configured to rotate in response to reciprocation of the pistons. The fuel tank is configured to store liquid fuel. The air cleaner is configured to filter air for combustion. The throttle body includes an inlet and an outlet. The inlet is fluidly coupled to the air cleaner to receive filtered air. The intake manifold includes a manifold inlet fluidly coupled to the outlet of throttle body and two manifold branches. Each branch includes a throat extending between an inlet port and an outlet port. The inlet port is fluidly coupled to the manifold inlet to receive filtered air. Each electronic fuel injector module is coupled to a single manifold branch of the two manifold branches and a single cylinder of the two cylinders. Each module includes a fuel delivery injector unit having a fuel inlet and an outlet passage. The fuel inlet if fluidly coupled to the fuel tank to receive liquid fuel. The outlet passage is fluidly coupled to the respective throat to provide fuel to mix with the filtered air. The outlet port is fluidly coupled to the respective cylinder intake port to provide a fuel-air mixture for combustion in the cylinder.

BRIEF DESCRIPTION OF THE DRAWINGS

The disclosure will become more fully understood from the following detailed description, taken in conjunction with the accompanying drawings, in which.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 4:
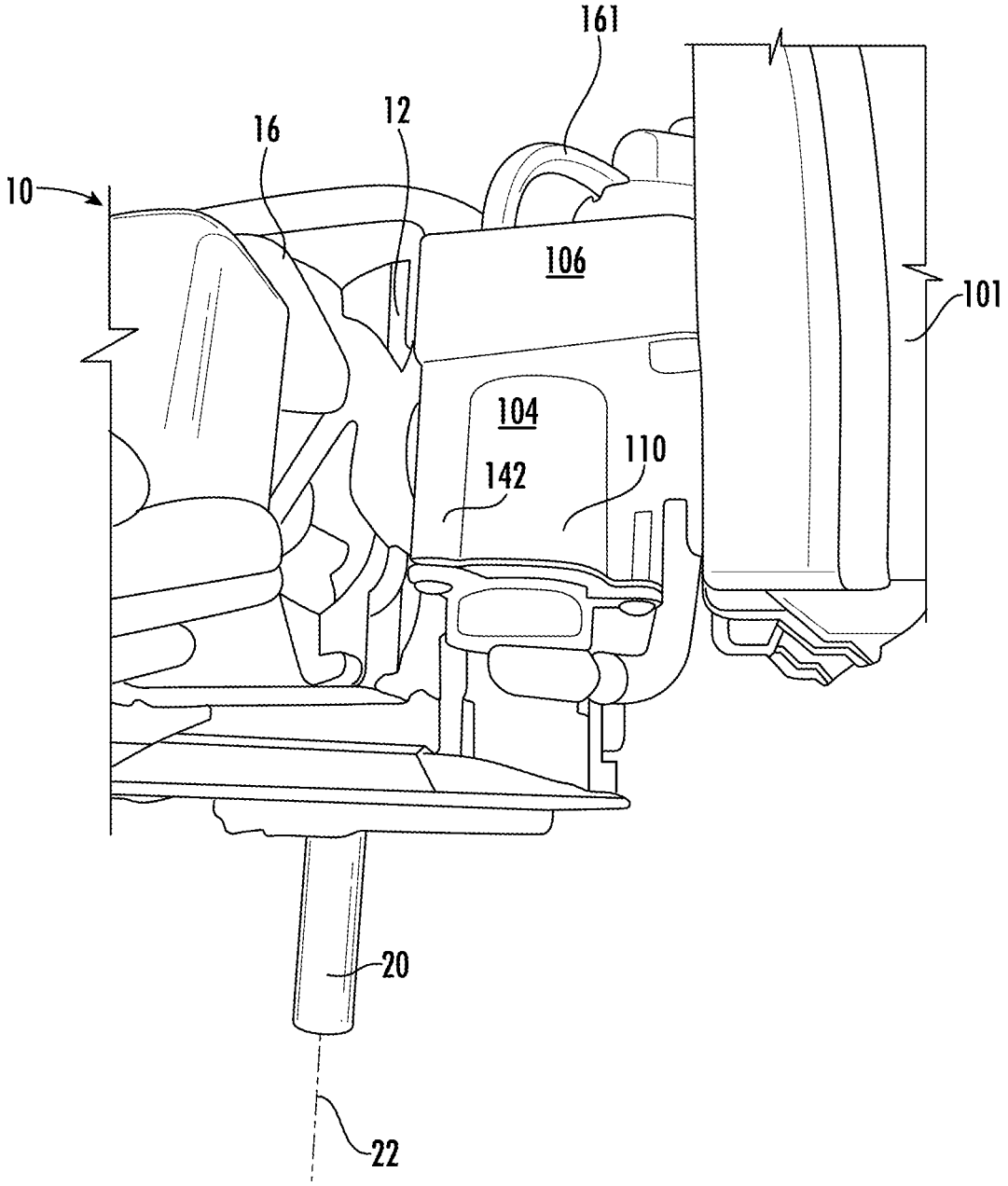
FIG. 4 is another perspective view of a portion of the engine of FIG. 1.

Referring to FIGS. 1-5, a fuel-air mixing system is illustrated according to an exemplary embodiment. The fuel-air mixing system 100 is shown as part of a small air-cooled single cylinder engine 10, for example, for use with a walk-behind mower. The engine 10 includes an engine block having a cylinder 12, a piston, a cylinder head 16, and a cylinder intake port. The piston 14 reciprocates in the cylinder 12 to drive a crankshaft 20. The crankshaft rotates about a crankshaft axis 22. As shown in FIG. 4, in some embodiments, the engine 10 is vertically shafted, while in other embodiments, the engine 10 is horizontally shafted. In some embodiments, the engine includes multiple cylinders, for example, a two cylinder engine arranged in a V-twin configuration.

The engine 10 may be used in outdoor power equipment, standby generators, or other appropriate uses. Outdoor power equipment includes lawn mowers, riding tractors, snow throwers, fertilizer spreaders and sprayers, salt spreaders and sprayers, chemical spreaders and sprayers, pressure washers, tillers, log splitters, zero-turn radius mowers, walk-behind mowers, wide area walk-behind mowers, riding mowers, stand-on mowers, pavement surface preparation devices, industrial vehicles such as forklifts, utility vehicles, commercial turf equipment such as blowers, vacuums, debris loaders, over-seeders, power rakes, aerators, sod cutters, brush mowers, etc. Outdoor power equipment may, for example use an internal combustion engine to drive an implement, such as a rotary blade of a lawn mower, a pump of a pressure washer, the auger of a snow thrower, the alternator of a generator, and/or a drivetrain of the outdoor power equipment.

As shown in FIGS. 1-5, the fuel-air mixing system 100 includes an air cleaner 101, a fuel tank 102, and an electronic fuel injection (EFI) module 103 that includes a throttle body 104, a fuel delivery injector (FDI) unit 110, and an electronic controller 122 (e.g., engine control unit) housed within a circuitry compartment 106. In some embodiments, the fuel-air mixing system 100 includes a throttle actuator 124 positioned within the circuitry compartment 106 in electrical communication with the controller 122.

Figure 2:
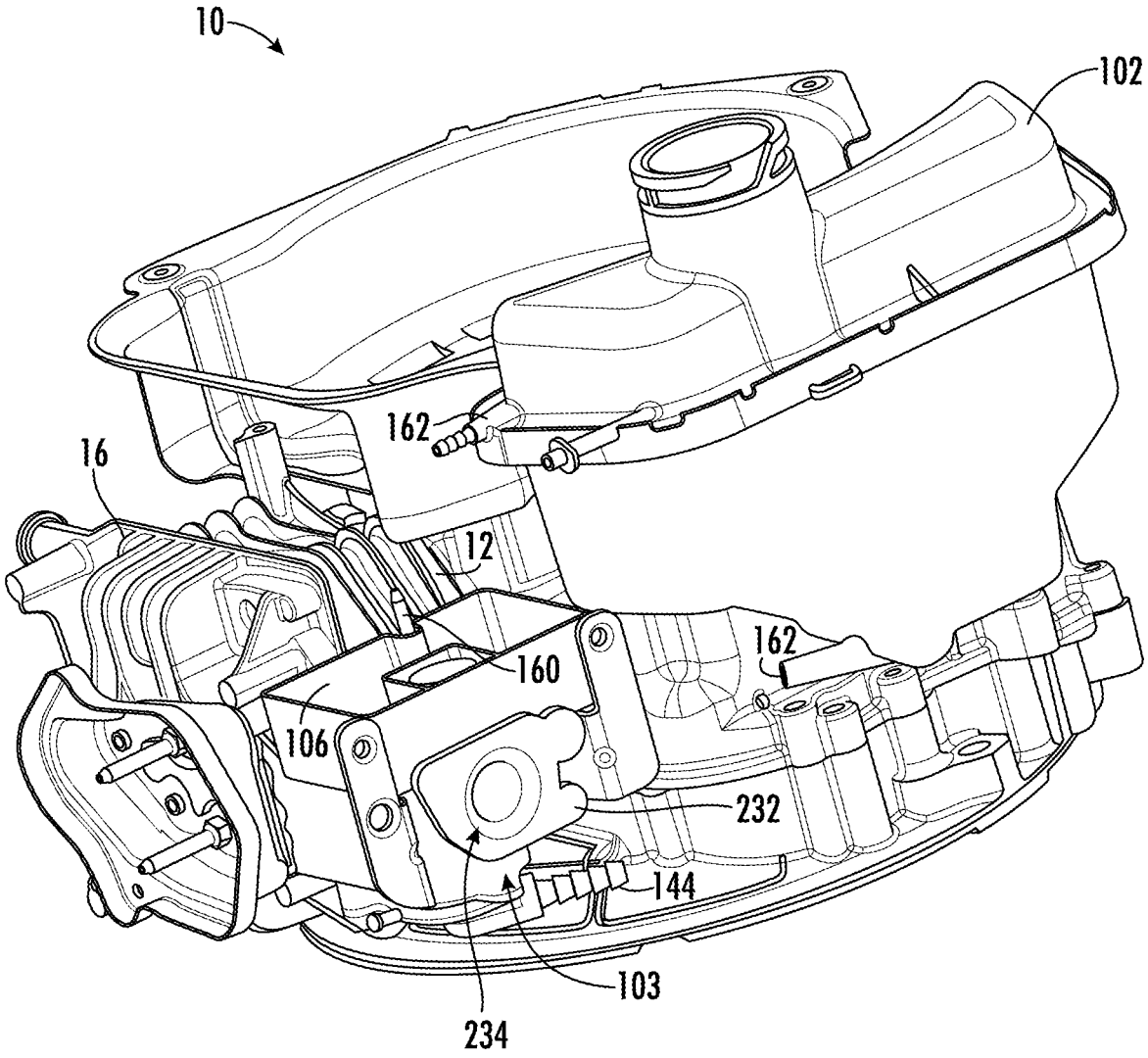
FIG. 2 is another perspective view of a portion of the engine of FIG. 1.
Figure 3:
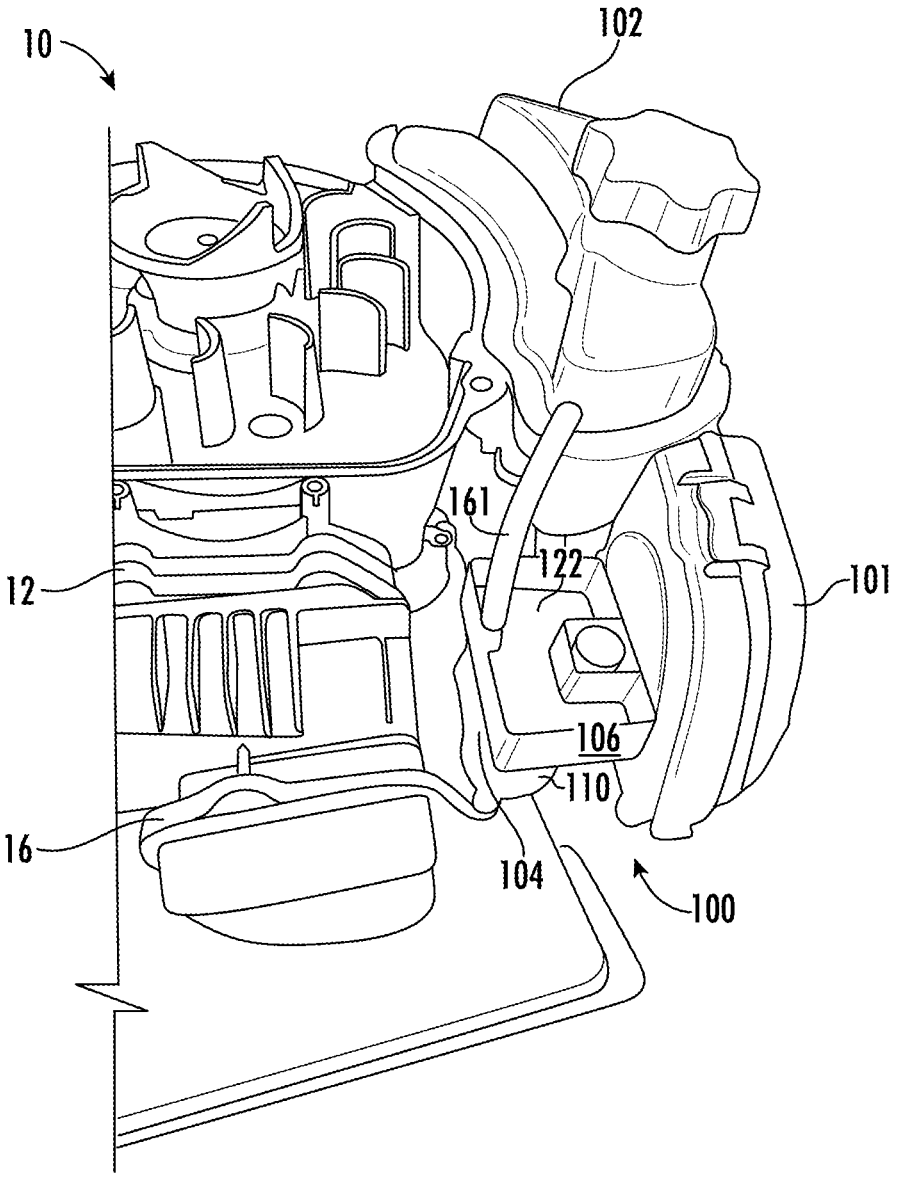
FIG. 3 is another perspective view of a portion of the engine of FIG. 1.
Figure 5:
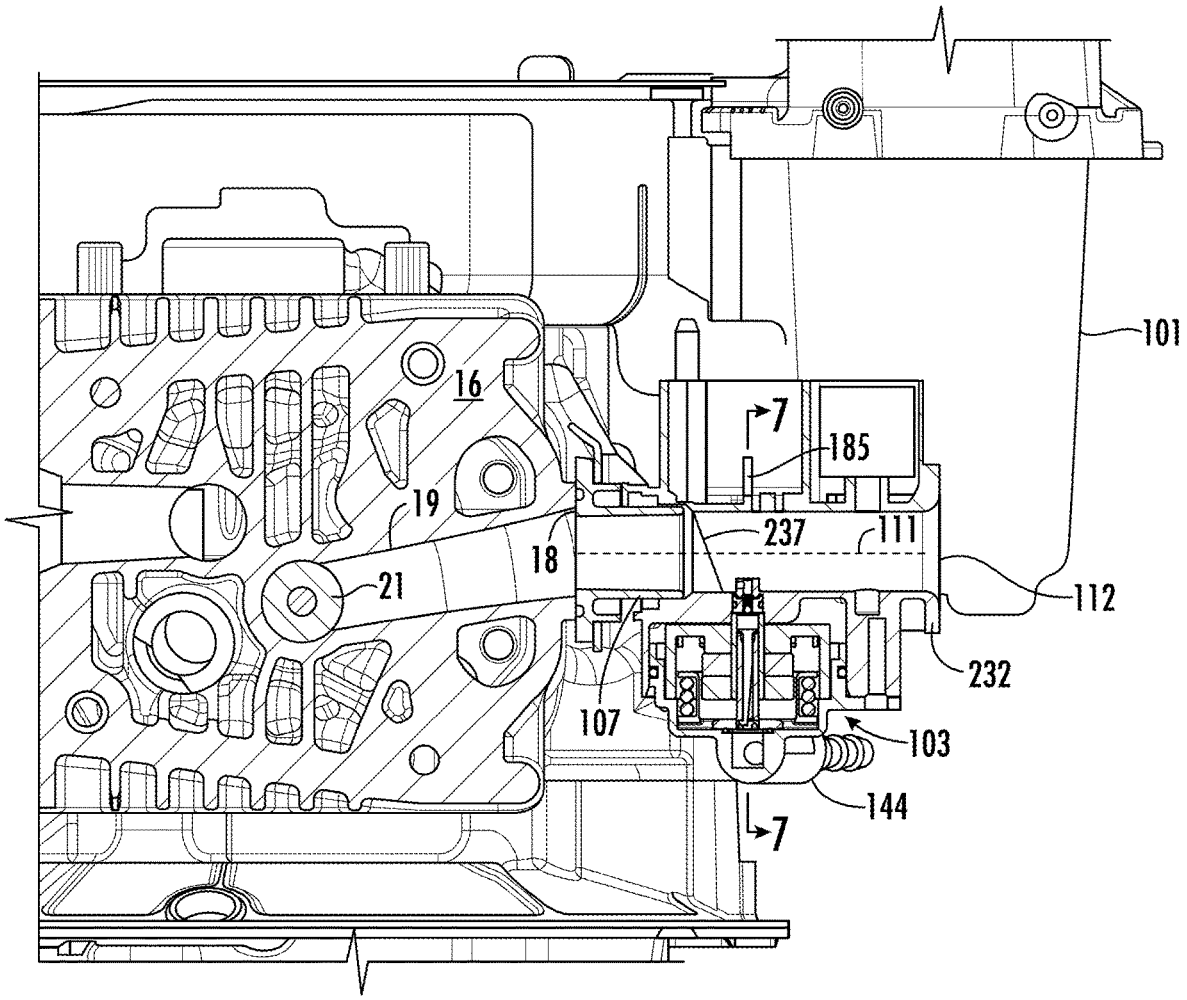
FIG. 5 is a section view of a portion of the engine of FIG. 1.
Figure 6:
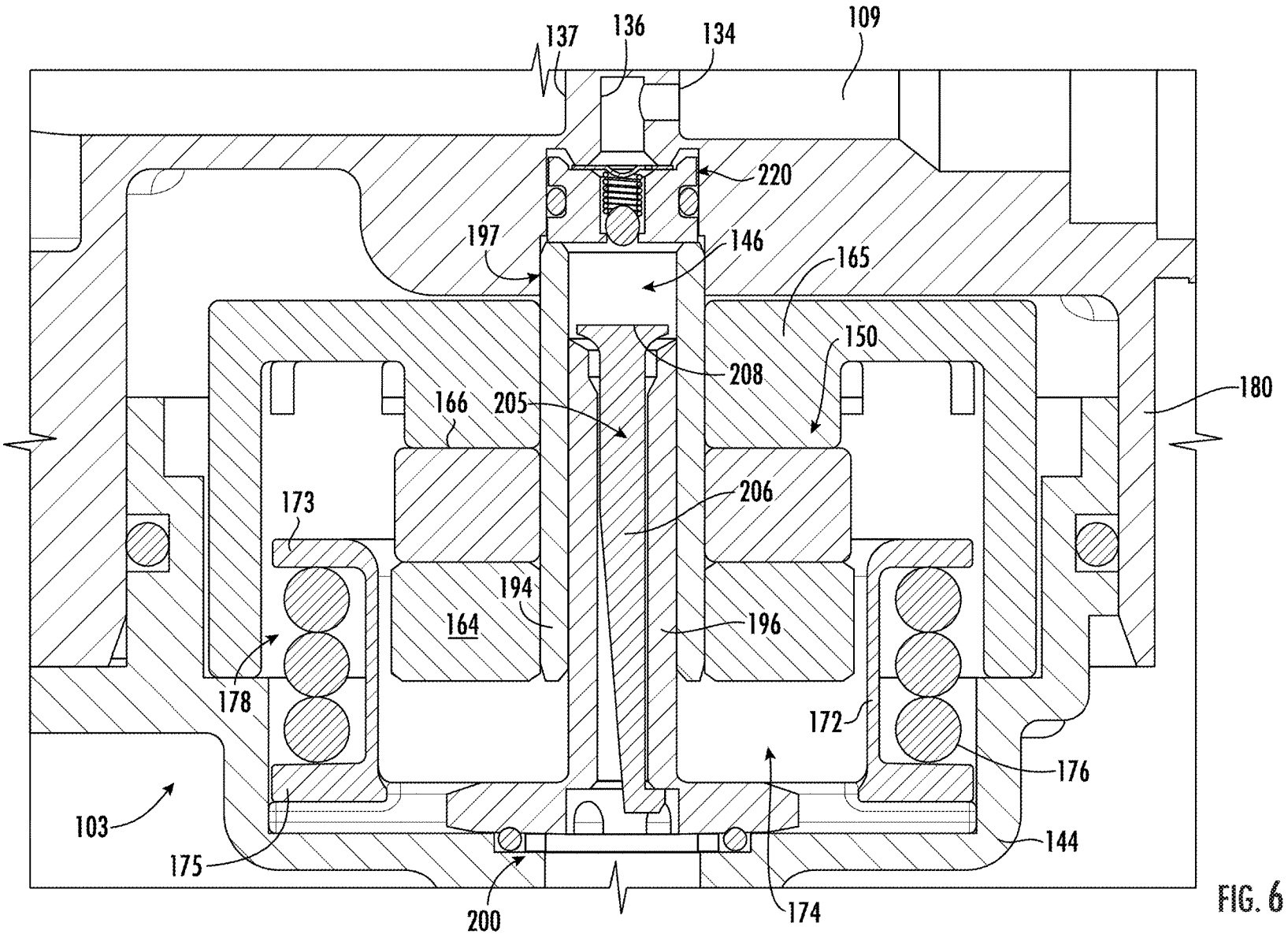
FIG. 6 is a section view of the electronic fuel injection module of FIG. 1.

The air cleaner 101 is configured to receive and filter ambient air from an external environment to remove particulates (e.g., dirt, pollen, etc.) from the air. As shown in FIG. 5, the air cleaner 101 is fluidly coupled to the throttle body 104 by a cleaned air conduit 112, such that the clean air may travel from the air cleaner 101 to the throttle body 104. According to an exemplary embodiment, the throttle body 104 is configured to receive and selectively control (e.g., throttle, etc.) the amount of air that flows from the throttle body 104 to the cylinder intake port 18 of the cylinder 12 (e.g., to provide a desired amount of air for a fuel-air mixture for combustion within the cylinder head 16, etc.). As shown in FIG. 2, the throttle body 104 is fluidly coupled to the cylinder intake port 18 by a fitting 107, such that the throttled fuel-air mixture travels from throttle body 104 into the cylinder head 16. In some embodiments, the throttle body 104 is directly coupled to the cylinder intake port 18 without the use of the fitting 107.

Figure 7:
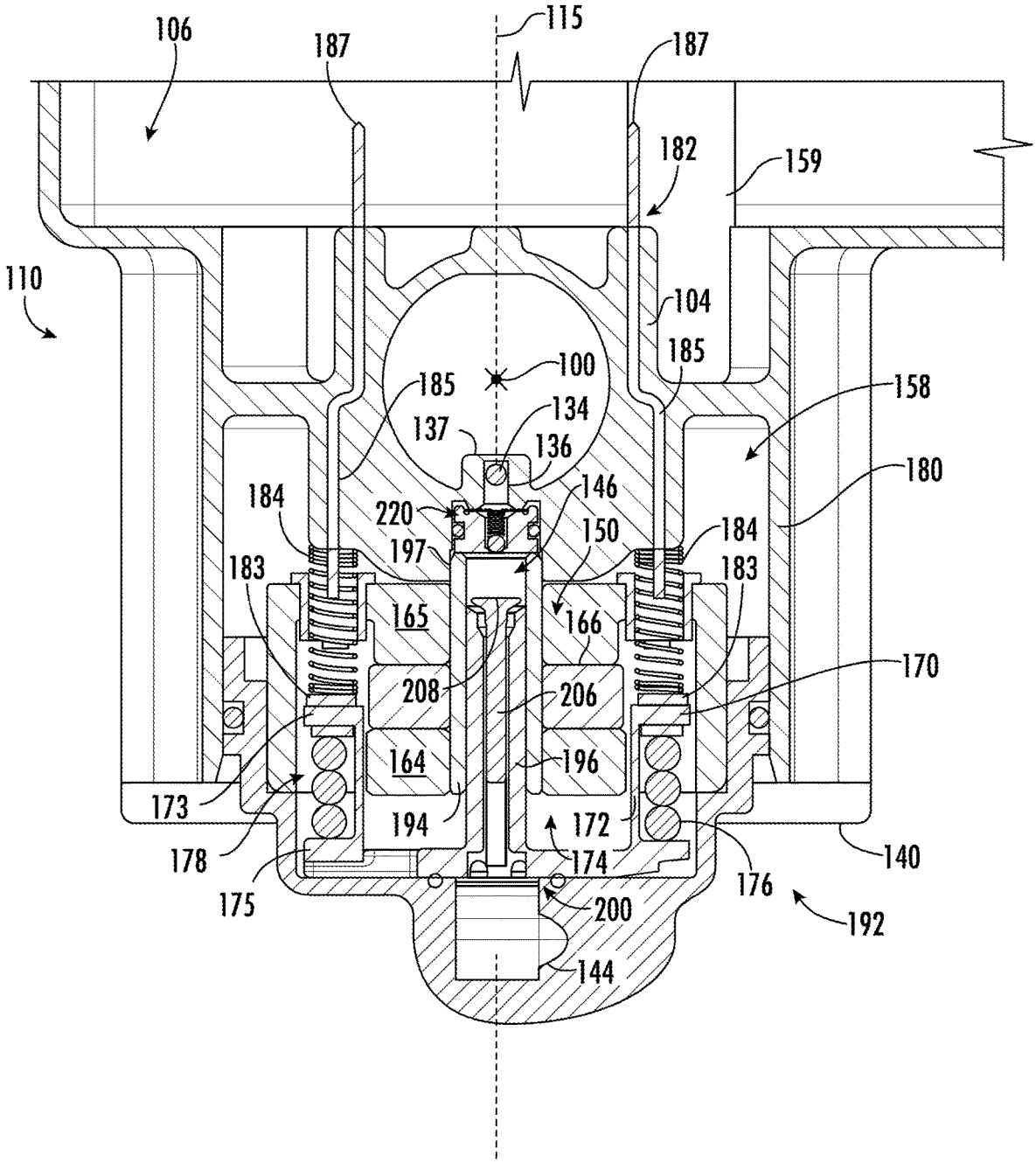
FIG. 7 is a section view of the electronic fuel injection module of FIG. 1, taken along line 7-7 of FIG. 5.

The throttle body 104 includes an inlet 232 including inlet port 234 and an outlet 235 including an outlet port 236, and a throttle plate 237. The inlet 231 is configured to couple to the cleaned air conduit 112 such that the throttle body 104 receives clean air via the inlet port 234. The throttle plate 237 may be selectively controlled (e.g., by a throttle lever, electronic governor, etc.) to modulate (e.g., throttle, etc.) the flow of the fuel-air mixture exiting the throttle body 104 via the outlet port. A throat 109 of the throttle body 104 extends between the inlet port 234 and the outlet port 236. As illustrated in FIG. 7, the throat 109 has a substantially constant diameter except for a boss or protrusion 137 that includes a fluid outlet 134 and an outlet passage 136. In some embodiments, the boss 137 is omitted and the throat 109 has a substantially constant diameter along its entire length. As illustrated in FIG. 7, the throat 109 does not include a venturi as would typically be found in a throttle body used with a carburetor. The throat 109 extends longitudinally along an axis 111. The outlet 235 of the throttle body 104 is configured to couple to the cylinder head 16 either directly or via the fitting 107 so that the throat 109 is fluidly coupled to cylinder intake port 18 via the outlet port 236 to provide a throttled fuel-air mixture to the cylinder head 16. As shown in FIG. 5, the cylinder head 16 including an intake passage 19 extending from the cylinder intake port 18 to an intake valve 21, which controls the flow of the fuel-air mixture to the combustion chamber of the cylinder 12. There is no manifold or other intervening structure beyond the fitting 107 between the throttle body 104 and the cylinder intake port 18. The fitting 107 is a component of a throttle body assembly as the fitting 107 serves as an extension of the throat 109 to allow the throat 109 to fluidly couple with the cylinder intake port 18.

The EFI module 103 is designed to fit in the same location as the carburetor of a carbureted small air-cooled engine, immediately between the cleaned air conduit 112 of the air cleaner and the cylinder intake port 18 of a cylinder 12. This allows an engine manufacturer to use the same primary engine components (i.e., engine block, piston(s), and cylinder head(s)) to manufacture carbureted engines including a carburetor and electronic fuel injection engines including the EFI module 103. This increases the number of options the engine manufacturer can offer to customers without having to redesign the primary engine components to provide an electronic fuel injection option.

The FDI unit 110 includes a frame 180 (which is a portion of the throttle body 104) and a pumping assembly 192 that includes a cover 140, a magnetic assembly 150, an invalve assembly 200, a piston 196, and a bobbin 170. In some embodiments, the frame 180 is not a portion of the throttle body 104 and is instead a separate component. The frame 180 defines a central, longitudinal axis 115 that is perpendicular to the central longitudinal axis 111 of the throat 109 of the throttle body 104. As shown in FIG. 4, the frame 180 includes a coupling interface, shown as bosses or mounting locations 142. According to an exemplary embodiment, the mounting locations 142 are configured to facilitate coupling (e.g., attaching, securing, etc.) the pumping assembly 192 to the frame 180 by providing locations for fasteners or other attachments to couple the pumping assembly 192 to the frame 180. In other embodiments, the pumping assembly 192 may be coupled to the frame 180 by a twist-lock feature, an adhesive, or heat-staking. The frame 180 defines an internal cavity, shown as cavity 158. The cavity 158 is configured (e.g., sized, structured, etc.) to receive and/or support the magnetic assembly 150, the bobbin 170, and the piston 196, and a volume of fuel. A vent passage 159 is in fluid communication with the cavity 158 to allow fuel vapor to travel from the FDI unit 110 to the fuel tank 102. At least a portion of the vent passage 159 is formed in a vent outlet 160 that allows a vent conduit 161 to be coupled to the EFI module 103. The other end of the vent conduit 161 is coupled to a vent inlet 162 of the fuel tank 102 so that the vent conduit 161 provides a flow path for the fuel vapor to travel from the EFI module 103 to the fuel tank 102. In some embodiments, a valve is provided in the vent passage 159 to allow vapor through but preventing liquid from returning to the fuel tank 102. For example, a rollover valve would allow vapor through and then be closed if liquid in the cavity 158 reaches a threshold level.

The cover 140 forms an inlet 144 configured to receive and direct a liquid fuel (e.g., liquid gasoline) from the fuel tank 102 into the cavity 158. The fuel inlet 144 is positioned below the fuel tank 102 so that liquid fuel is delivered to the fuel inlet 144 via gravity. Applicant has found that a fuel pump is not necessary to provide sufficient liquid fuel to the fuel delivery injector unit 110 with the fuel tank 102 positioned above the fuel inlet 144 as illustrated in the figures. In alternative embodiments, where the fuel tank cannot be positioned in a location capable of providing a sufficient gravity-fed fuel supply to the fuel inlet, a fuel pump may be used to supply fuel to the fuel inlet. In some embodiments, one or more filter elements surround the frame 180 of the pumping assembly 192 such that fuel provided to the pumping assembly 192 from the fuel tank 102 is filtered prior to entering the pumping assembly 192. In other embodiments, the filter element can be otherwise positioned. The pumping assembly 192 also includes a pressure chamber 146 configured to receive and direct liquid fuel out of the cavity 158 and through the fluid outlet 134. From the pressure chamber 146, the liquid fuel enters an outlet passage 136 through the outvalve assembly 220 and the then travels through the outlet passage 136 to the fluid outlet 134. Fuel flows through the FDI unit 110 from the bottom to the top, entering through the inlet 144 on the bottom portion of the FDI unit 110 and exiting through the fluid outlet 134 on the top portion of the FDI unit 110. With the fuel delivery injector 110 in a normal operating position, the fuel inlet 144 is located near a bottom portion of the fuel delivery injector unit 110 and the outlet passage 136 is located near a top portion of the fuel delivery injector 110. This arrangement is similar to the fuel flow path through a conventional carburetor and helps to allow the EFI module 103 to serve as a replacement in function and location for a carburetor in a small air-cooled engine.

The magnetic assembly 150 includes one pole 164, one magnet 166, a yoke 165, and a sleeve 194. The sleeve 194 is located within the pole 164, the yoke 165, and the magnet 166 and extends from the top of the magnetic assembly 150 to the bottom of the magnetic assembly 150.Further, the sleeve 194 is hollow to allow the flow of fluid through the sleeve 194 and to further provide an area the piston 196 may extend and retract within. The sleeve 194 serves as a pin to secure the pole 164, the yoke, 165, and the magnet 166. The sleeve 194 is non-magnetic. In some embodiments, the sleeve 194 is press fit into openings in the pole 164, the yoke 165, and the magnet 166 to secure the sleeve 194, pole 164, yoke 165, and magnet 166 together. The magnetic assembly 150 is fixed (i.e., stationary, does not move) within the cavity 158. In some embodiments, the magnetic assembly 150 includes multiple poles and multiple magnets.

The pumping assembly 192 further includes a bobbin 170, configured to reciprocate relative to the magnetic assembly 150. According to an exemplary embodiment, the bobbin 170 is configured to translate linearly along the central axis 115, relative to the pole 164 and the magnet 166. The bobbin 170 includes a peripheral wall, shown as wall 172 that extends around the periphery of the bobbin 170. The wall 172 defines a cup shape having a cavity, shown as inner cavity 174. An outer cavity 178 is formed between two flanges 173 and 175 extending outward from the wall 172. The inner cavity 174 receives the pole 164 and the magnet 166. The bobbin 170 includes a coil 176, disposed along a periphery of the wall 172 of the bobbin 170 such that the coil 176 is positioned radially between the wall 172 and the frame 180 within the outer cavity 178. Electrifying the coil 176 causes the coil 176 and the bobbin 170 to move relative to the magnetic assembly 150, rather than a magnet moving relative to an electrified coil as in a solenoid coil. In one embodiment, the electrical wiring that forms the coil 176 is over-molded to the bobbin 170 to secure the coil 176 to the bobbin 170. In another embodiment, the electrical wiring that forms the coil 176 is coated with a urethane coating to secure the coil 176 to the bobbin 170. In still another embodiment, the electrical wiring that forms the coil 176 is a bondable wire that may be melted to form a bond layer between the electrical wiring and the bobbin 170 to secure the coil 176 to the bobbin 170. In other embodiments, the bobbin 170 and the magnetic assembly 150 are arranged as a solenoid coil in which the magnetic assembly moves relative to the coil.

The pumping assembly 192 includes an electrical connector assemblyl82 to provide electricity to the coil 176. Providing electricity to the coil 176 causes the coil 176 to generate a magnetic field that interacts with the magnetic field of the magnetic assembly 150 thereby causing movement of the bobbin 170. According to the embodiment shown in FIG. 7, the electrical connector assembly 182 includes a pair of springs 184. Each spring 184 is electrically connected to the coil 176 by a connection terminal 183. Each spring 184 is also electrically connected to a conductor 185 that extends through the throttle body 104 to the circuitry compartment 106 of the EFI module 103. Each conductor 185 includes an external portion 187 that extends into the circuitry compartment 106 for electrical connection to the electronic controller 122, which controls the application of power to the conductors 185 to electrify the coil 176. In some embodiments, the throttle body 104 is plastic and the conductors 185 are molded into the throttle body 104 when the throttle body 104 is created. In other embodiments, the throttle body 104 is aluminum or another metal and the conductors 185 are surrounded by an insulator to electrically isolate the conductors 185 from the throttle body 104.

Figure 8:
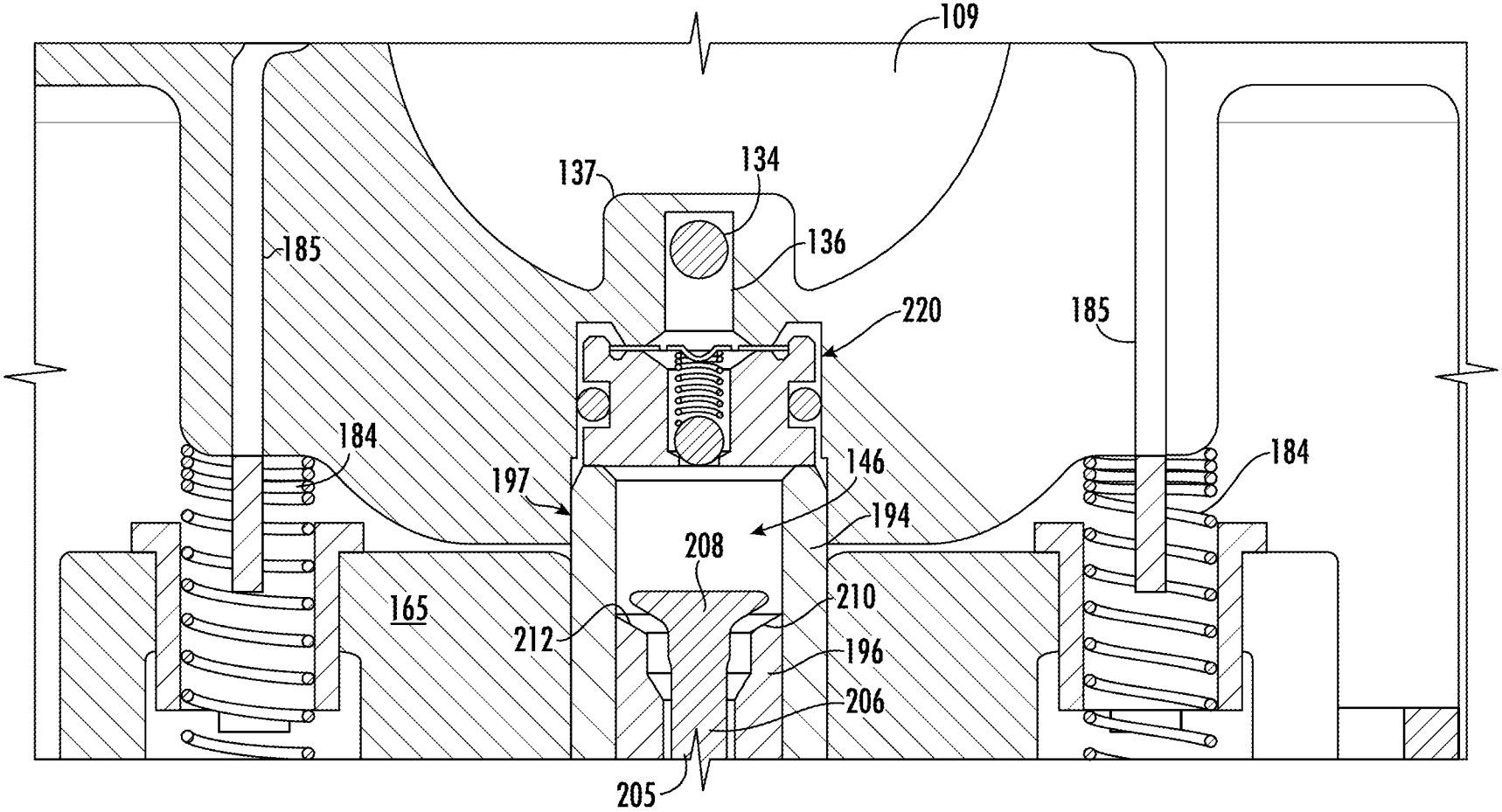
FIG. 8 is a detail view the electronic fuel injection module of FIG. 7.
Figure 9:
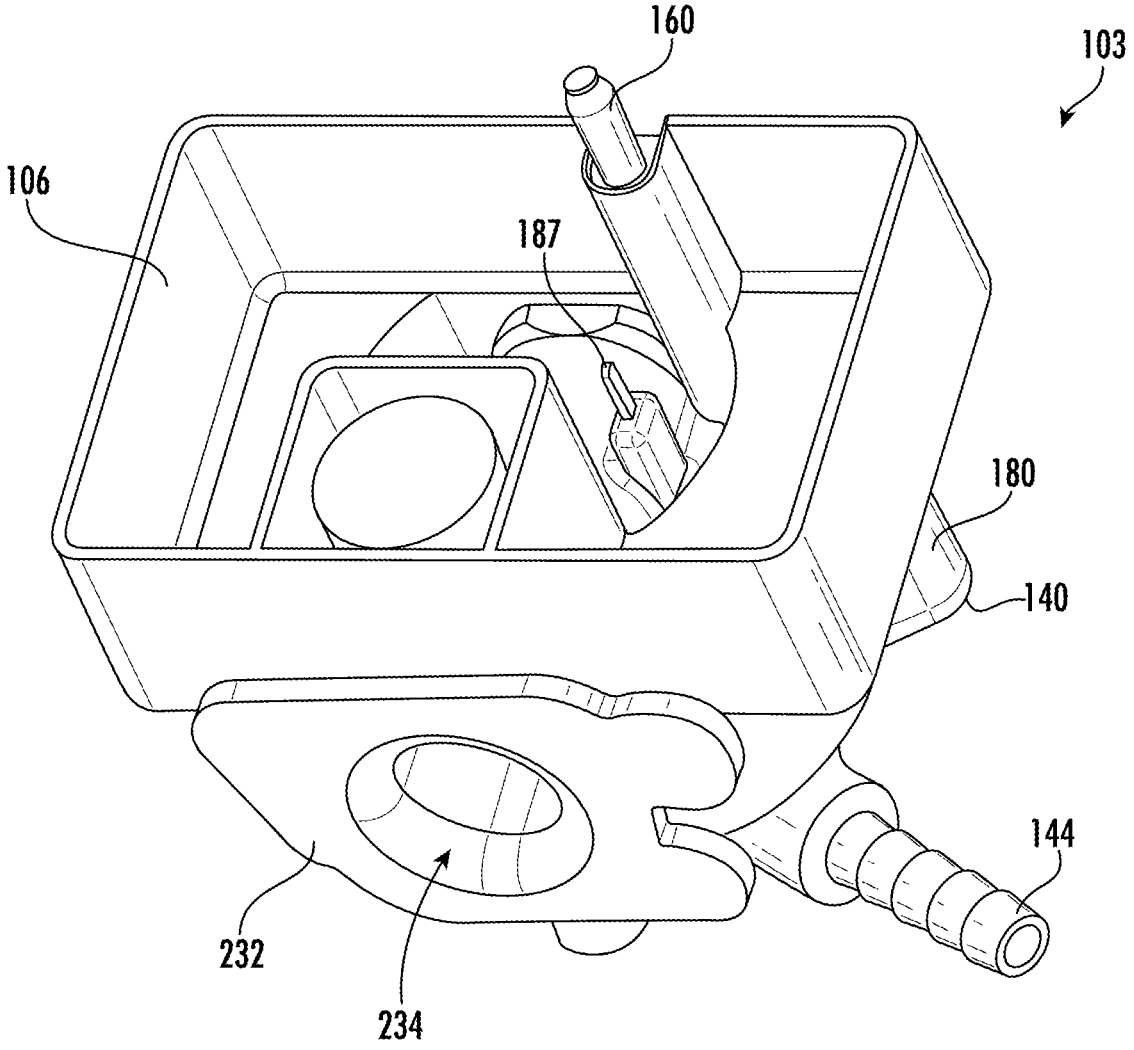
FIG. 9 is a perspective view from above of the electronic fuel injection module of FIG. 1.
Figure 10:
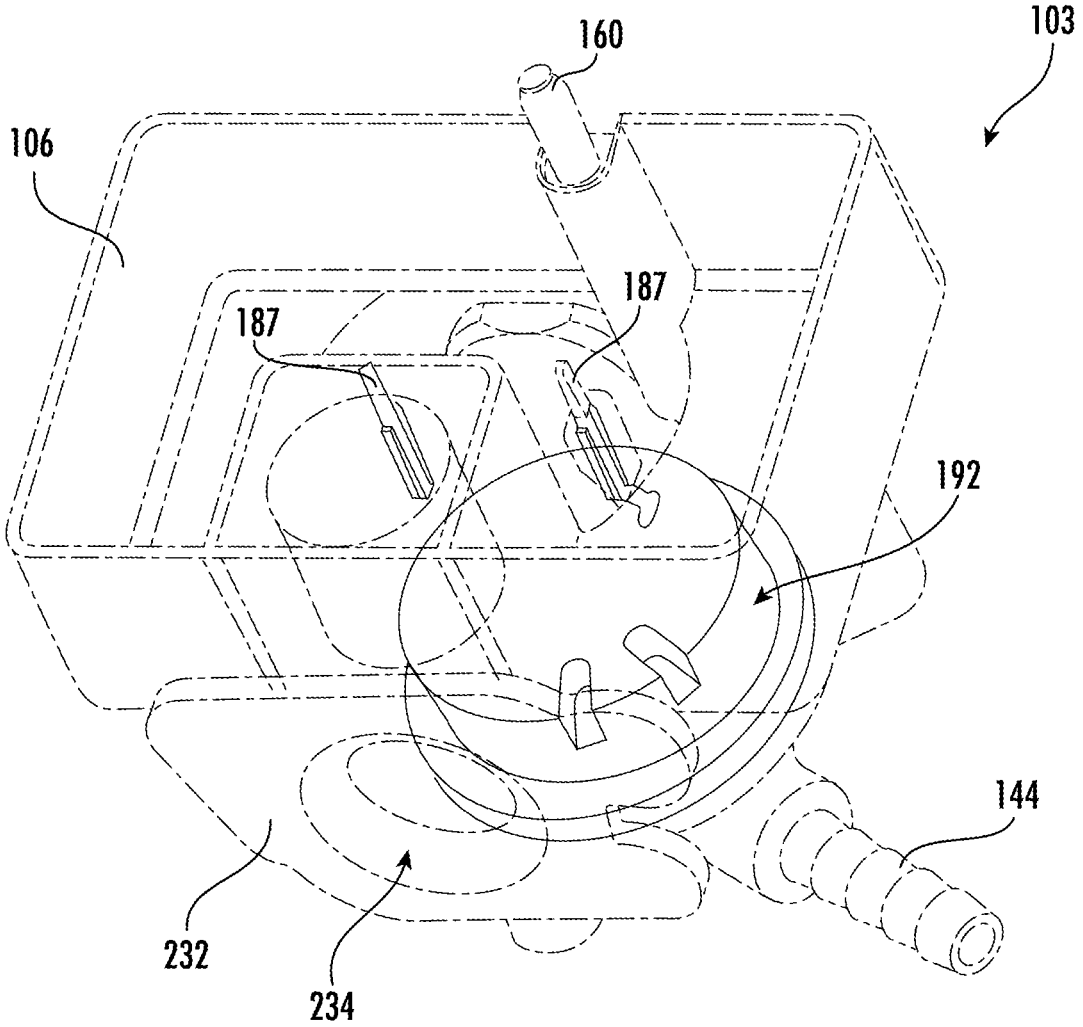
FIG. 10 is a transparent perspective view from above of the electronic fuel injection module of FIG. 1.
Figure 11:
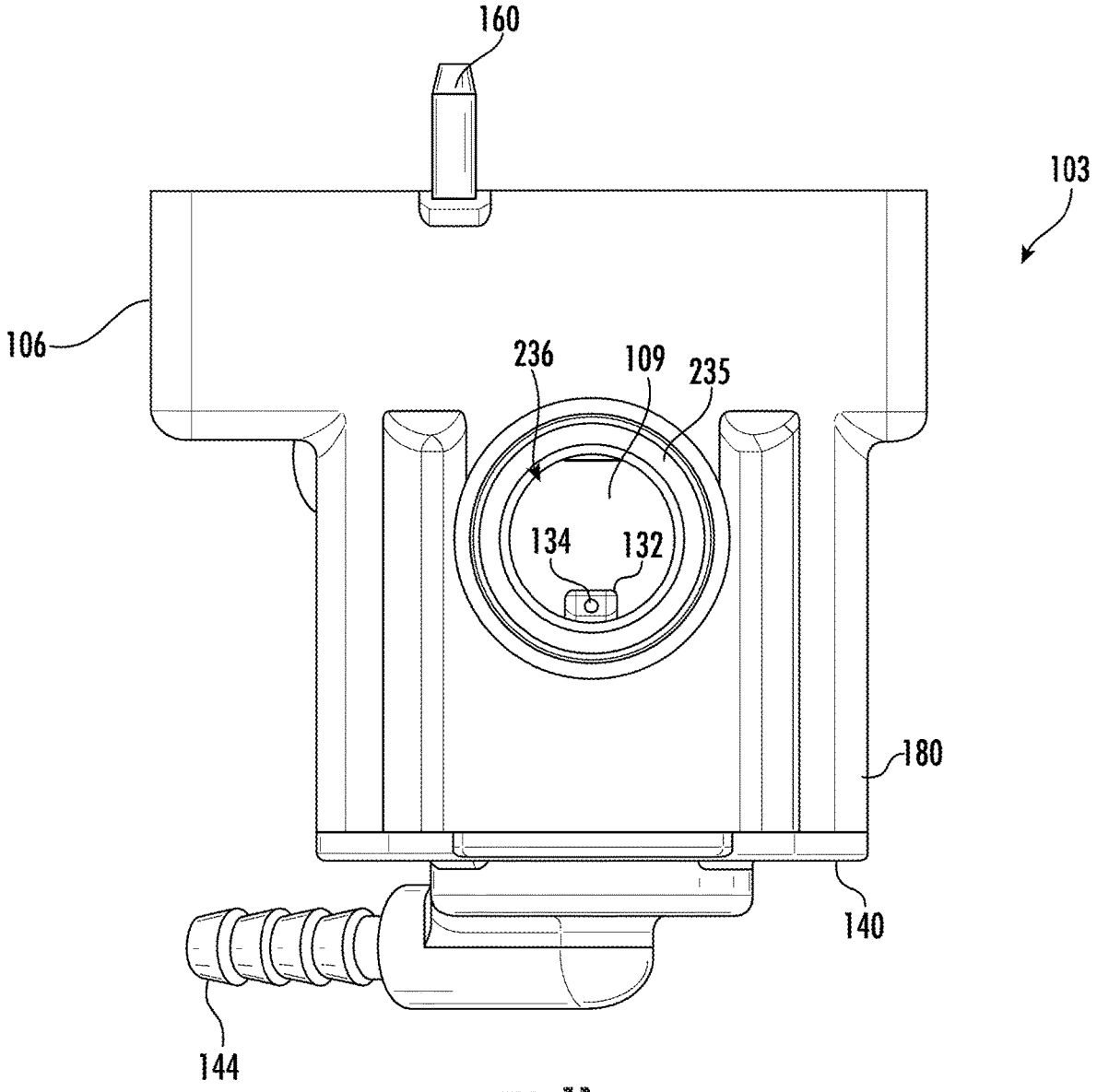
FIG. 11 is a front view of the electronic fuel injection module of FIG. 1.
Figure 12:
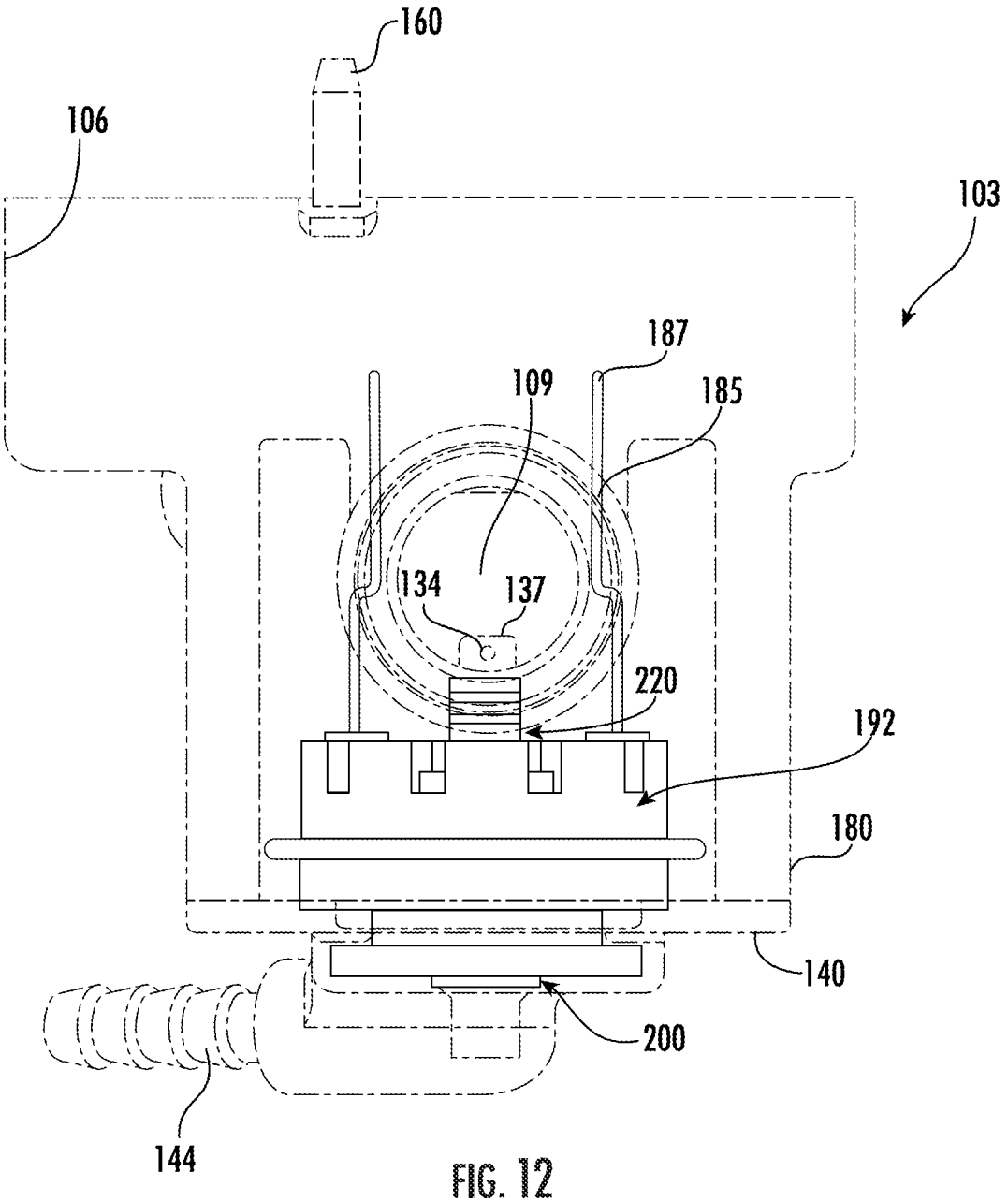
FIG. 12 is a transparent front view of the electronic fuel injection module of FIG. 1.
Figure 13:
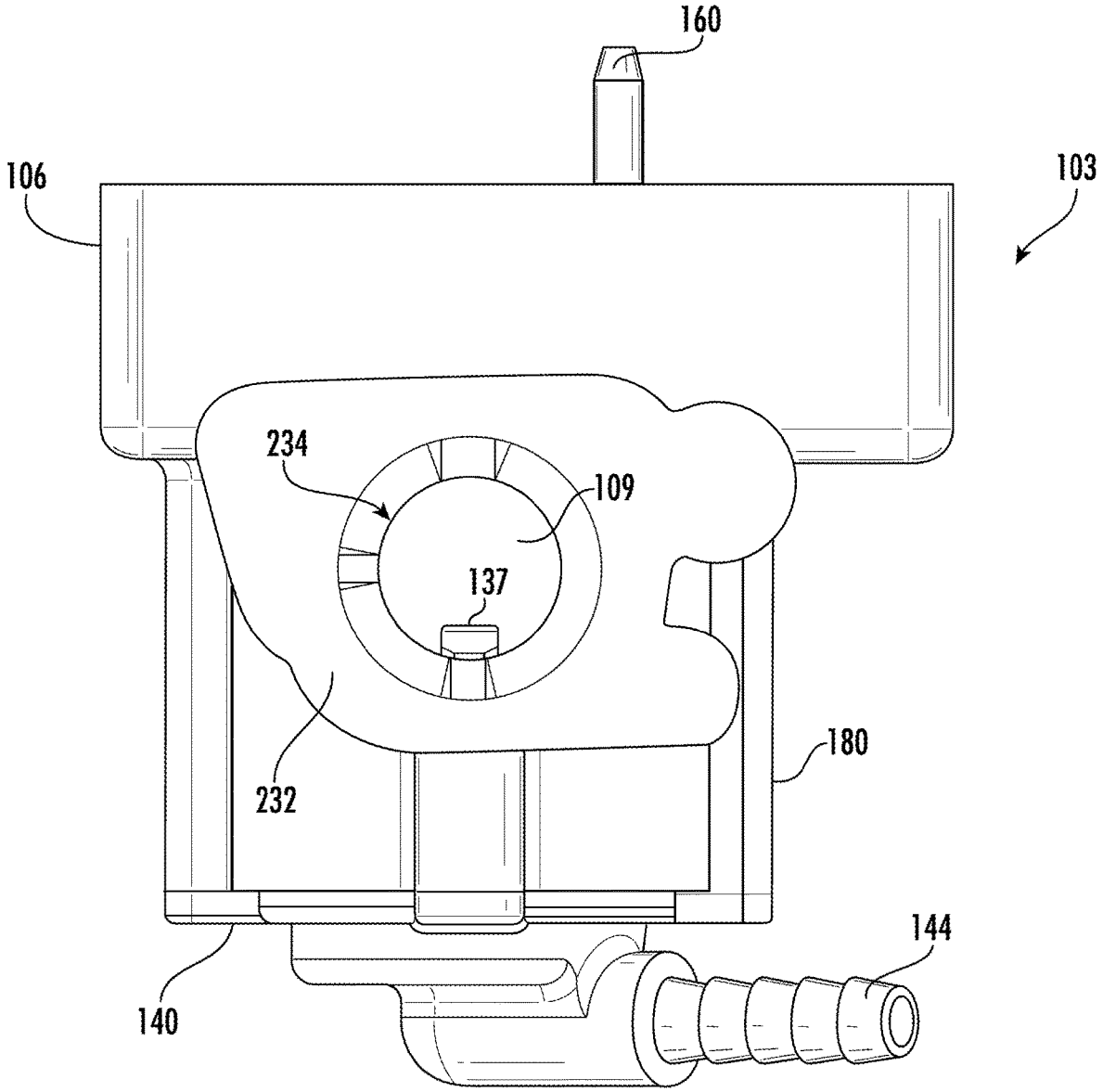
FIG. 13 is a rear view of the electronic fuel injection module of FIG. 1.
Figure 14:
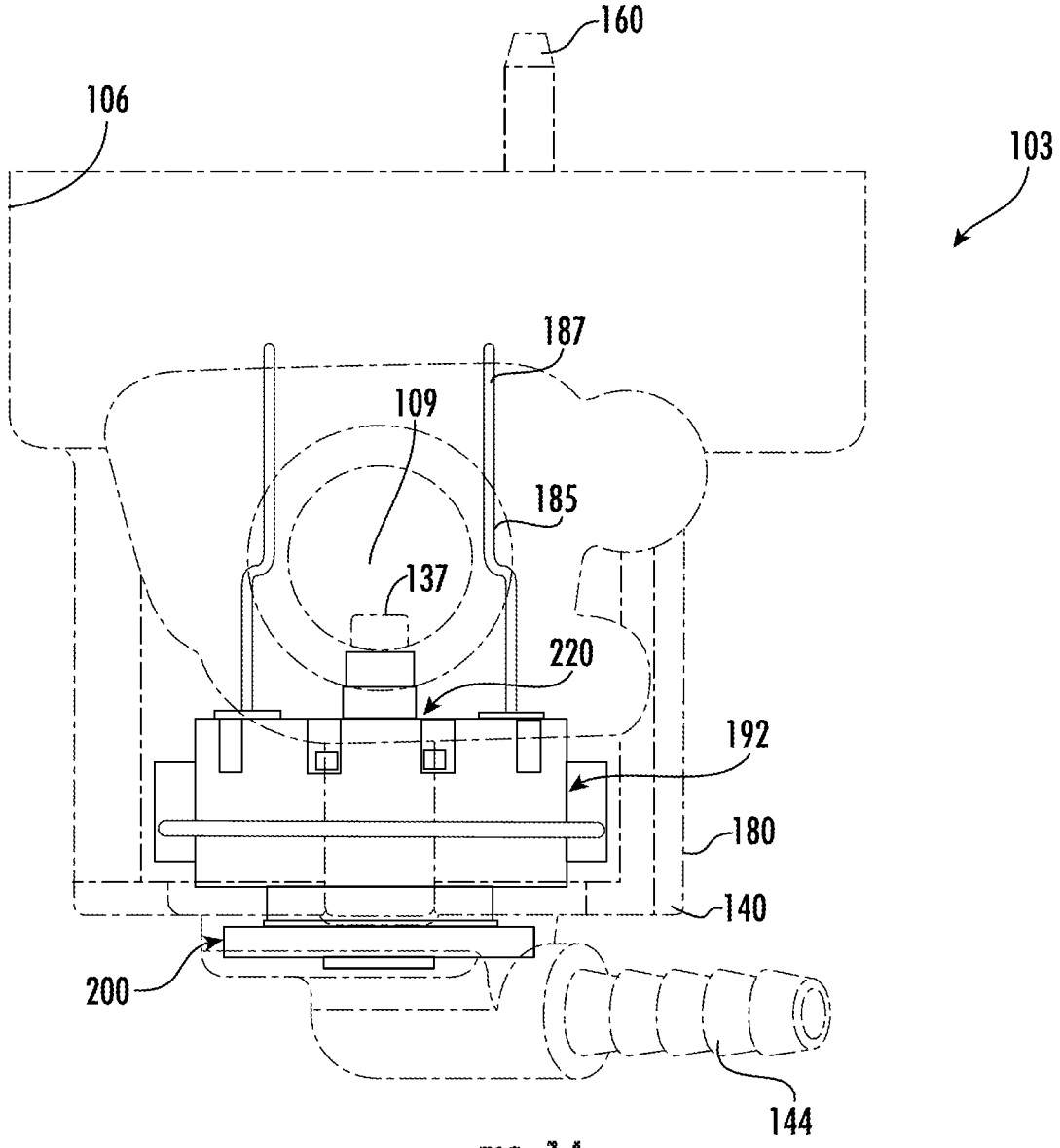
FIG. 14 is a transparent rear view of the electronic fuel injection module of FIG. 1.
Figure 15:
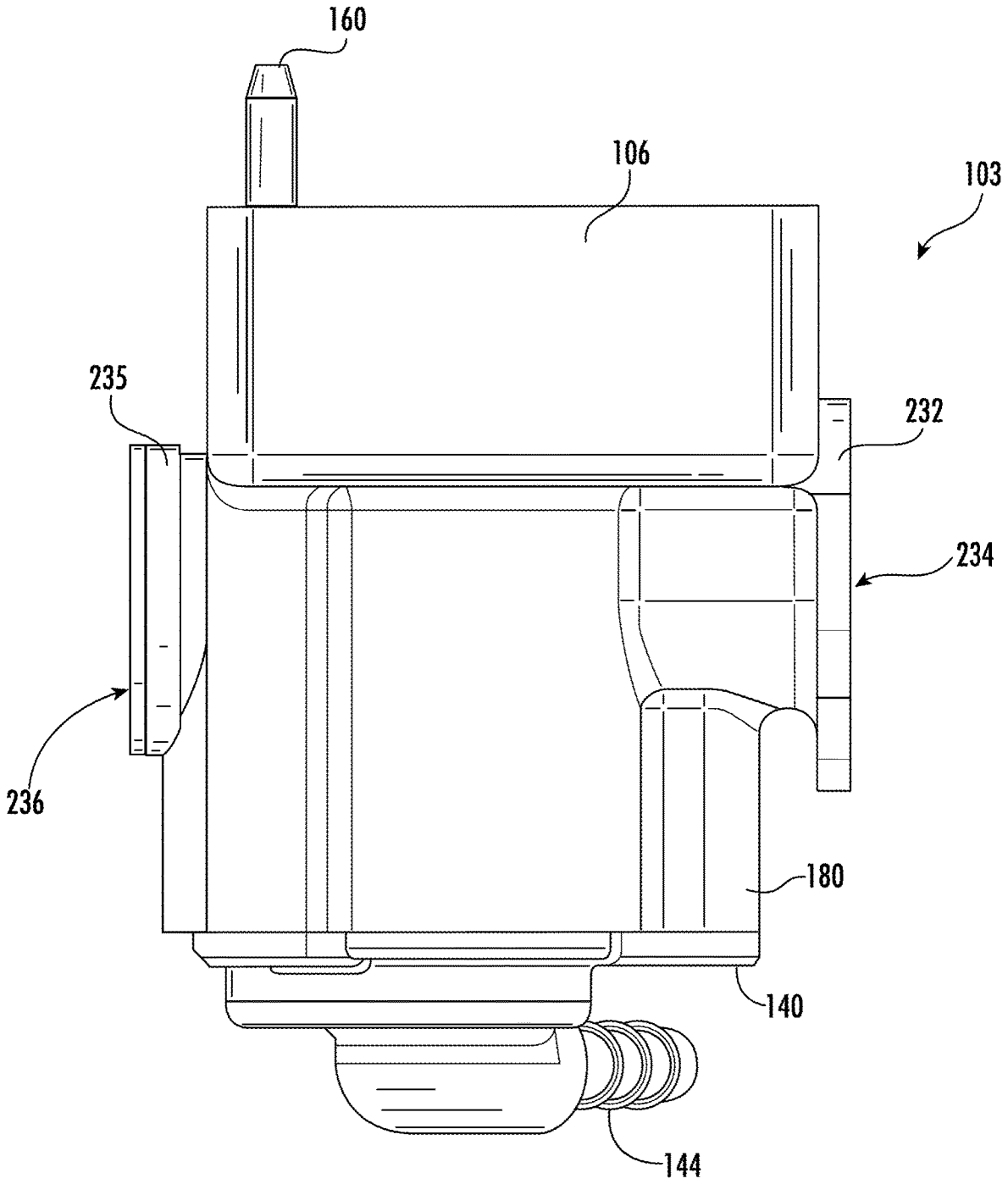
FIG. 15 is a left side view of the electronic fuel injection module of FIG. 1.
Figure 16:
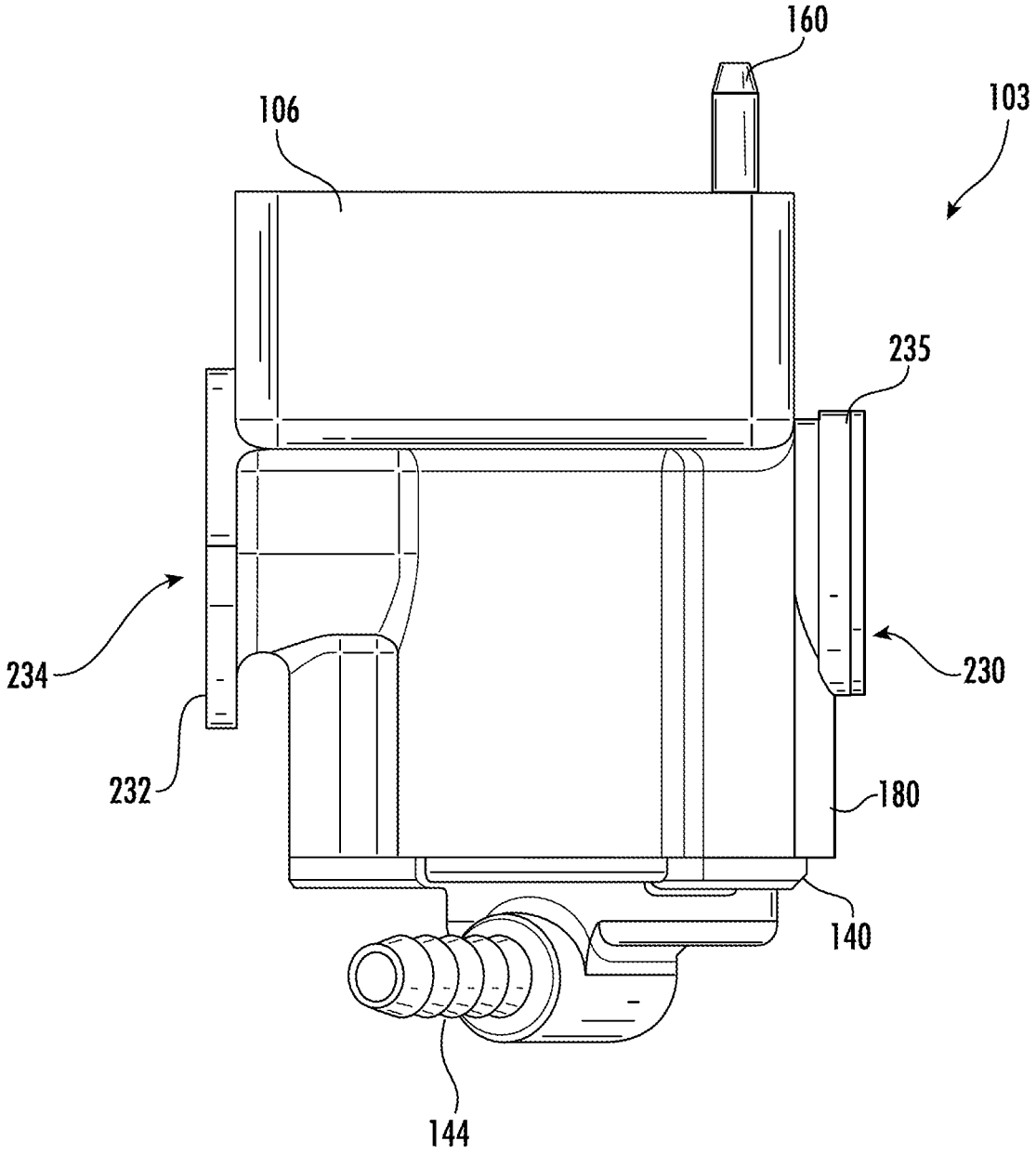
FIG. 16 is a left side view of the electronic fuel injection module of FIG. 1.
Figure 17:
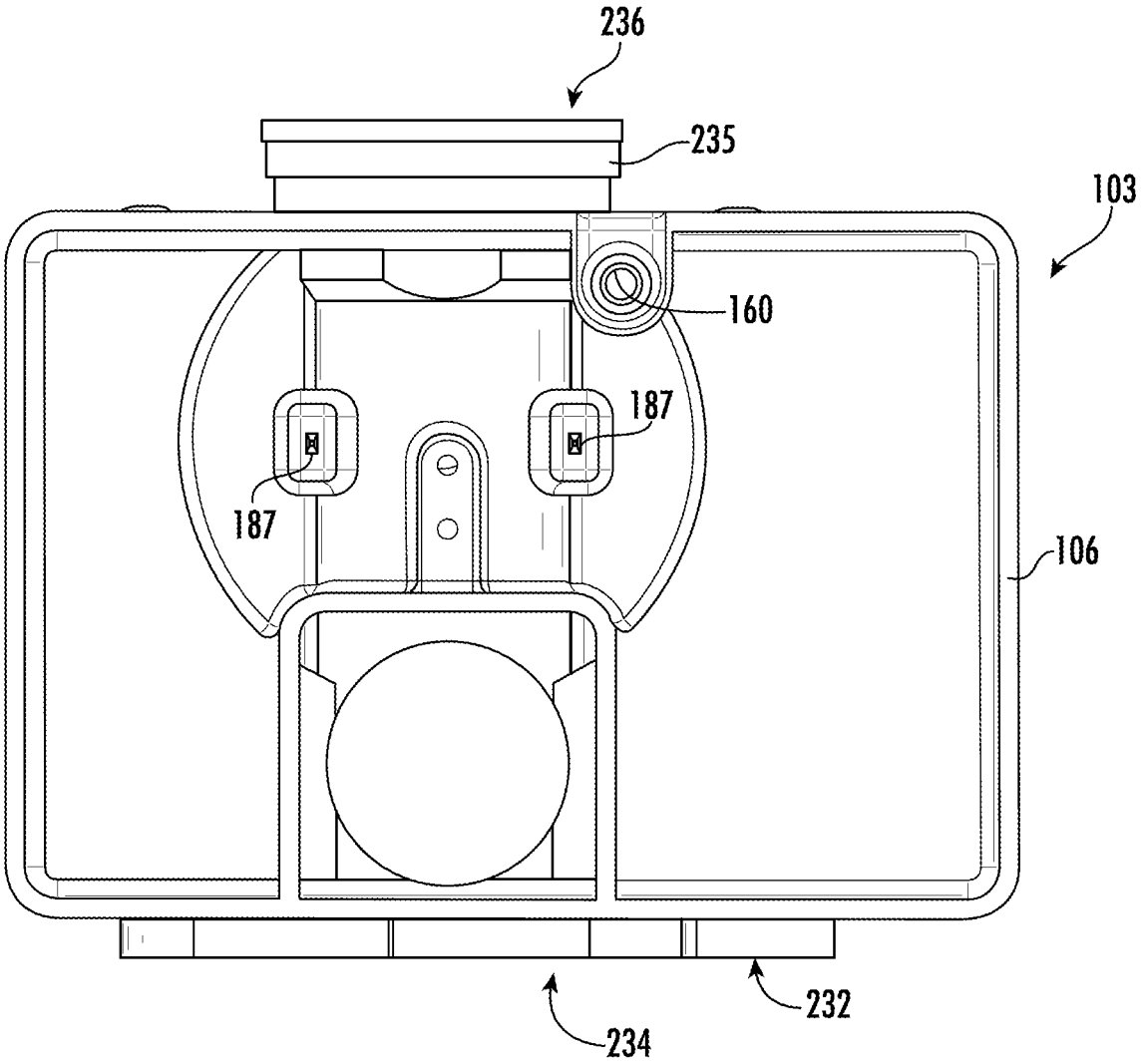
FIG. 17 is a top view of the electronic fuel injection module of FIG. 1.
Figure 18:
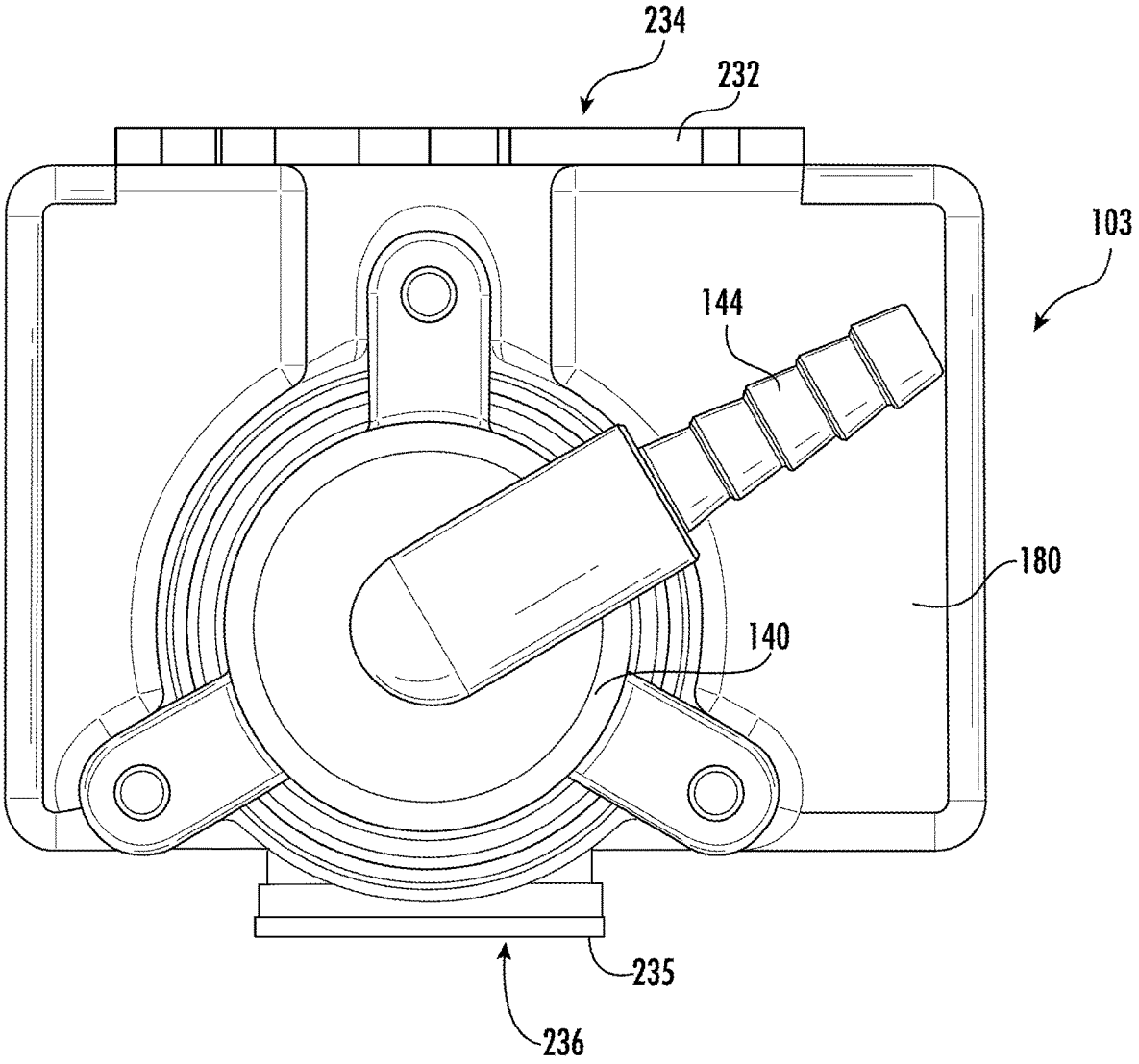
FIG. 18 is a bottom view of the electronic fuel injection module of FIG. 1.

Referring to FIG. 8, the sleeve 194 is secured to the throttle body 104 at an opening 197 in the throttle body 104 that extends for a depth sufficient to allow a portion of the sleeve 194 to extend into the opening 197 and to accommodate the outvalve assembly 220 within the opening 197. In some embodiments, the sleeve 194 is press-fit into the opening 197. The opening 197 and the sleeve 194 have longitudinal axes that are coaxial with axis 115 when the sleeve 194 is secured at the opening 197.

The pumping assembly 192 includes the sleeve 194 and the piston 196. The piston 196 is received within the sleeve 194. As the sleeve 194 extends from the top of the magnetic assembly 150 to the bottom of the magnetic assembly 150, the piston 196 is also located within a periphery of the magnetic assembly 150 (between the top and the bottom and within the radius of the magnetic assembly 150 with regards to the central axis 115). The bobbin 170 transfers motion and forces generated by the coil 176 to the piston 196, thereby causing the piston 196 to extend and retract within the sleeve 194 (i.e., reciprocate along the central axis 115). In some embodiments, the piston 196 and the bobbin 170 are one integral piece manufactured at the same time. Commonly, a bobbin and a piston are manufactured separately as they have wide ranging uses, but in the pumping assembly 192, having them as one integral piece creates large advantages. As the bobbin 170 transfers motion to the piston 196, the pieces are essential to the function of the pumping assembly 192 and therefore the FDI unit 110. Commonly, the two pieces must be manufactured with tight tolerances to prevent the bobbin 170 and the piston 196 from shifting and separating from one another. This is expensive and wastes a large amount of time to manufacture. As the bobbin 170 and the piston 196 are one integral piece, the two cannot separate and therefore looser tolerances can be used in the manufacturing process. The springs 184 function as return springs to bias the bobbin 170 towards a resting position (e.g., downward as illustrated in FIG. 7). By way of example, energizing the coil 176 causes an extension stroke of the piston 196 and the springs 184 cause a return stroke of the piston 196 when the coil 176 is de-energized. As illustrated in FIG. 7, at least a portion of the piston 196 moves towards the magnetic assembly 150 during the extension stroke. Commonly, a piston of a pumping assembly moves away from a magnetic assembly during the extension stroke. As the piston 196 is located within the periphery of the magnetic assembly 150 and moves towards the magnetic assembly 150 during the extension stroke, the frame 180 can be smaller than is common. This provides a better usage of the limited space within the cavity 158.

An invalve assembly 200 is positioned within the sleeve 194. The invalve assembly 200 is configured to selectively control the flow of liquid fuel from the inlet 144 to the pressure chamber 146. As shown in FIG. 8, the invalve assembly 200 includes a valve 205 having a valve stem 206 and a valve body 208 extending outward from the valve stem 206. The valve body 208 is configured to selectively engage a valve seat 210 defined by the exterior face 212 of the piston 196. Such engagement between the valve body 208 and the valve seat 210 prevents the flow of the liquid fuel through an aperture of the valve seat 210 of the piston 196 from the pressure chamber 146 to the inlet 144 (i.e., the valve body 208 seals the valve seat 210). The valve stem 206 and the valve body 208 are coaxial with and translate along the central axis 115 to allow liquid fuel to flow through the invalve assembly 200 and the piston 196. The valve body 208 engages the valve seat 210 to prevent fuel flow therethrough in response to an extension stroke of the piston 196 (i.e., caused by energizing the coil 176.).

In further embodiments, the piston 196, the sleeve 194, and the valve 205 are made out of non-magnetic materials. The piston 196, the sleeve 194, and the valve 205 are located within the magnetic assembly 150. As the magnetic assembly 150 generates a magnetic field, components within the magnetic assembly 150 are affected by this field. If strong enough, the magnetic field can move or damage the piston 196, the sleeve 194, and the valve 205. Therefore to further protect the components and to allow the piston 196, the sleeve 194, and the valve 205 to be located within the magnetic assembly 150 they are made out of non-magnetic materials. This includes but is not limited to non-ferrous metals and polymers. Commonly, a piston is not located within a magnetic assembly and is instead located below the magnetic assembly as the piston may be acted upon by the magnetic forces of the magnetic assembly. As the piston 196 is commonly made out of non-magnetic materials (e.g.,non-ferrous metals and polymers), the piston 196 is located within the magnetic assembly 150. Therefore, the frame 180 does not need to extend as far or be as large as is common and instead the frame 180 can be smaller. This leads to a savings in cost and materials As shown in FIG. 8, according to an exemplary embodiment, the outvalve assembly 220 is positioned within the opening 197 in the throttle body 104. The outvalve assembly 220 is configured to selectively control the flow of liquid fuel out of the pressure chamber 146. The fuel that passes through the outvalve assembly 220 mixes with the air within the throat 109 of throttle body 104 and then the fuel-air mixture is delivered to the cylinder intake port 18.

Figure 1:
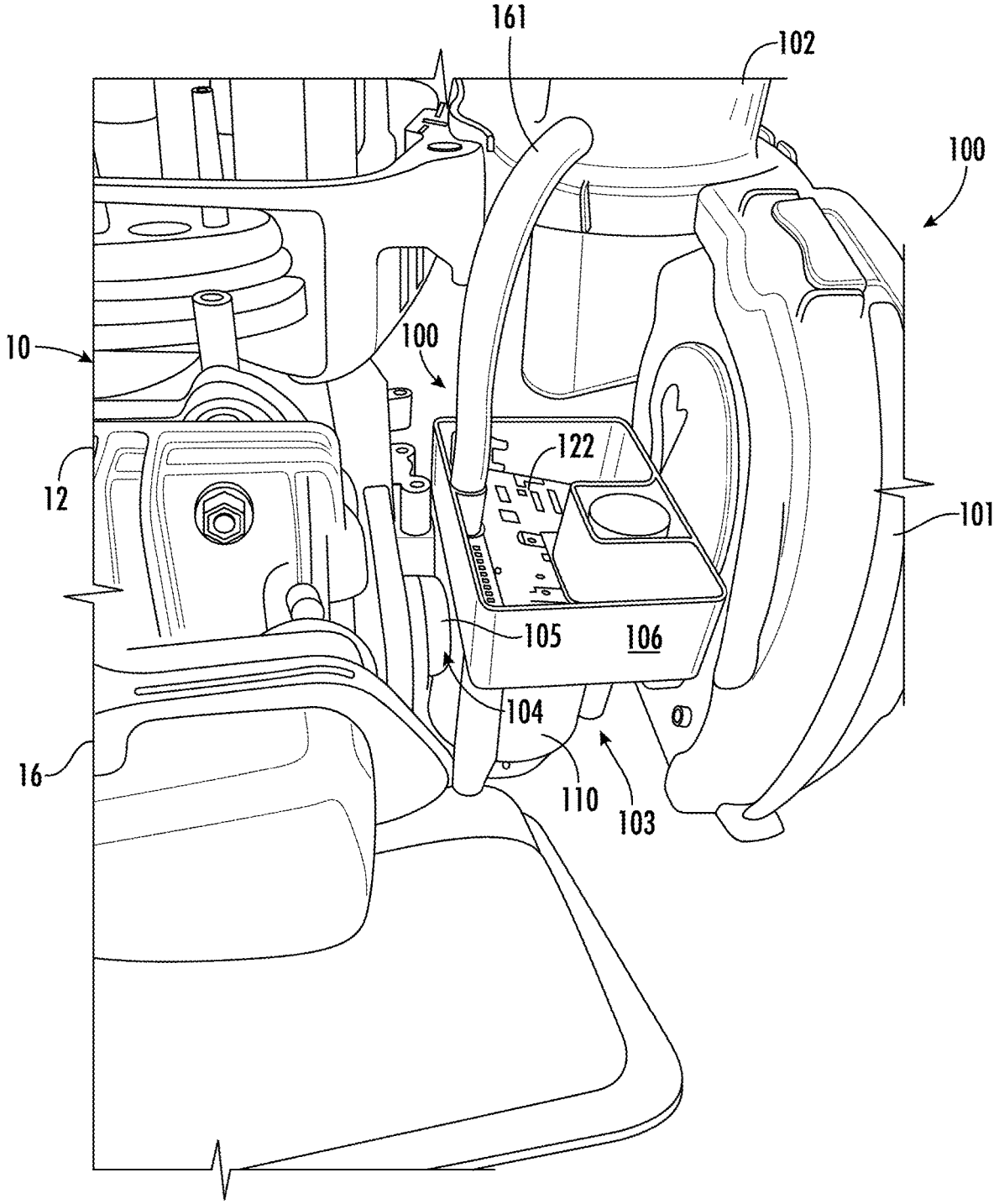
FIG. 1 is a perspective view of a portion of an engine including an electronic fuel injection module according to an exemplary embodiment.

Referring to FIG. 1, the circuitry compartment 106 houses the controller 122. The circuitry compartment 106 is integrally formed as a single unitary component with the throttle body housing 105 to form the throttle body 104. For example, the circuitry compartment 106 and the throttle body housing 105 may be s integrally molded or integrally cast during a manufacture process to form the throttle body 104. The circuitry compartment 106 is formed on a top portion of the throttle body 104 and is located above the throttle body housing 105. In other embodiments, the circuitry compartment may be formed on a side portion of the throttle body housing. In some embodiments, a portion of the air cleaner 101 is integrally formed with the throttle body housing 105 and the circuitry compartment 106 as a single unitary component. In some embodiments, the controller 122 is positioned remotely from the throttle body housing 105 and the circuity compartment is not a component of the throttle body 104.

Figure 19:
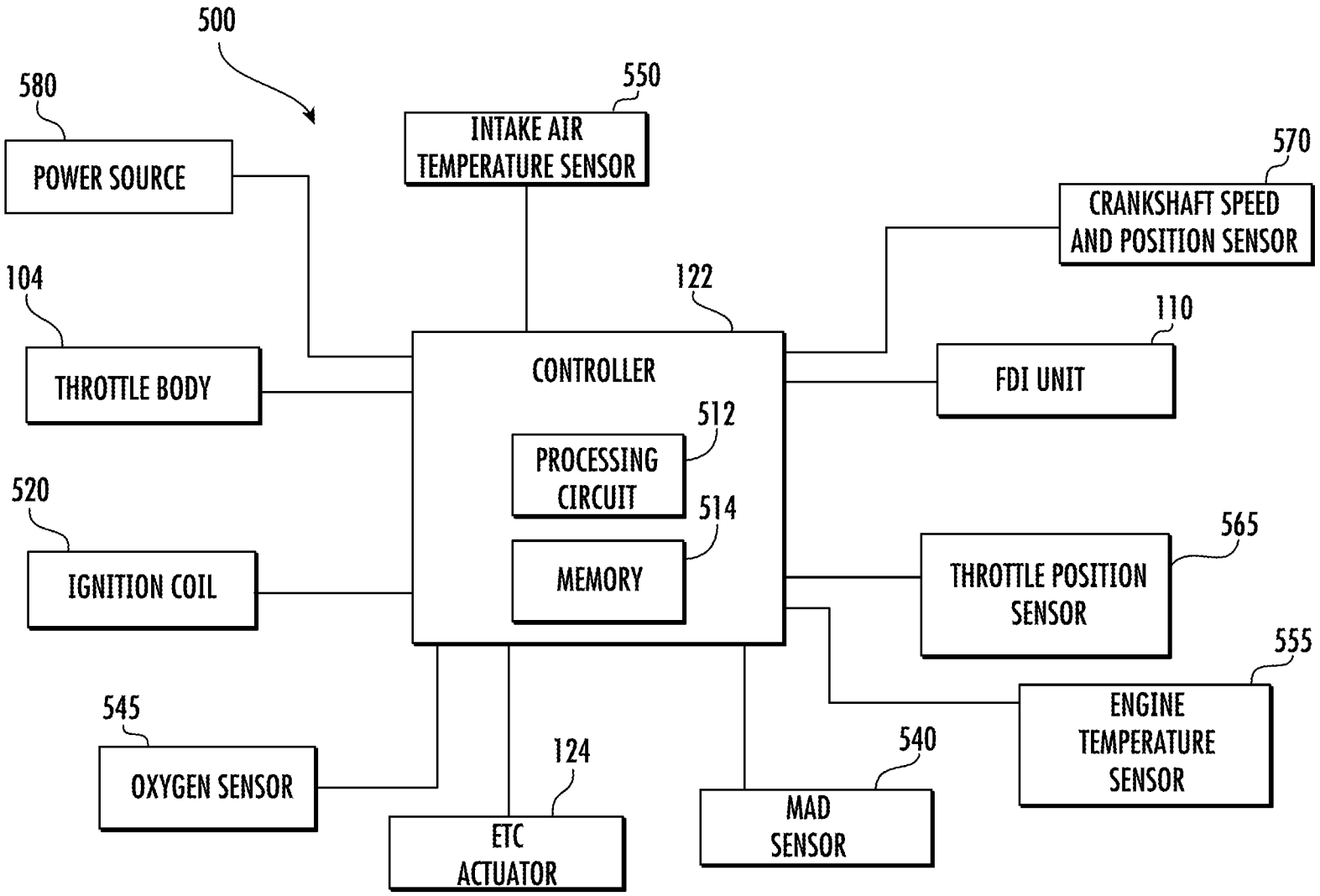
FIG. 19 is a schematic diagram of a controller of the electronic fuel injection module of FIG. 1, according to an exemplary embodiment.

Referring to FIG. 19, a control system 500 for the fuel-air mixing system 100 includes the controller 122. In one embodiment, the controller 122 is configured to selectively engage, selectively disengage, control, and/or otherwise communicate with components of the engine 10 and/or the FDI unit 110 (e.g., actively control the components thereof, etc.). As shown in FIG. 19, the controller 122 is coupled to the FDI unit 110, the throttle body 104, an ignition coil 520, an engine throttle control (ETC) actuator 124, a manifold absolute pressure (MAP) sensor 540, an intake air temperature sensor 550, an engine temperature sensor 555, a crankshaft speed and position sensor 570, and a power source 580 (e.g., a battery, a capacitor, a generator, etc.). In other embodiments, the controller 122 is coupled to more or fewer components. In some embodiments, the controller 122 is coupled to a throttle position sensor 565 configured to detect the position of the throttle valve or plate (e.g., the throttle angle). In some embodiments the controller 122 is coupled to an ETC actuator 124 to monitor and control the operation of the ETC actuator 124 and thereby control engine speed. In some embodiments, the controller 122 is coupled to an oxygen sensor 545. The oxygen sensor 545 may be used to enable closed loop fuel-air ratio control by monitoring oxygen levels (e.g., narrow band or wide band control). In some embodiments, the controller 122 includes one or more communication ports (e.g., for CAN, Wi-Fi, Bluetooth, cellular, K-line, or other communication protocols). By way of example, the controller 122 may send and/or receive signals with the pumping assembly 192, the throttle body 104, the ignition coil 520, the ETC actuator 124, the MAP sensor 540, the intake air temperature sensor 550, the crankshaft speed and position sensor 570, and/or the power source 580. In some embodiments, at least a portion of the controller 122 is disposed directly within the circuitry compartment 106 of the throttle body 104. In some embodiments, the ignition coil 520, MAP sensor 540, intake air temperature sensor 550, and ETC actuator 124 are mounted directly onto the board of the controller 122 within the circuitry compartment 106. In this way, the use of wiring and connectors in the fuel-air mixing system 100 can be limited.

The controller 122 includes a processing circuit 512 and a memory 514. The processing circuit 512 may include an ASIC, one or more FPGAs, a DSP, circuits containing one or more processing components, circuitry for supporting a microprocessor, a group of processing components, or other suitable electronic processing components. In some embodiments, the processing circuit 512 is configured to execute computer code stored in the memory 514 to facilitate the systems and processes described herein. The memory 514 may be any volatile or non-volatile computer-readable storage medium capable of storing data or computer code relating to the systems and processes described herein. According to an exemplary embodiment, the memory 514 includes computer code modules (e.g., executable code, object code, source code, script code, machine code, etc.) configured for execution by the processing circuit 512.

An engine throttle control (ETC) actuator 124 may be configured to facilitate electronically controlling the throttle of the engine 10. By way of example, the ETC actuator 124 may operate as an electronic governor for the engine 10. In some embodiments, the ETC actuator 124 is and/or includes a piezoelectric actuator (e.g., a piezo disc motor, etc.). The ETC actuator 124 may be positioned to directly connect with a throttle shaft of the engine 10 and/or with a transmission (e.g., a gearing system, etc.). The controller 122 may be configured to control the ETC actuator 124 to thereby control the throttle of the engine 10. In other embodiments, the engine 10 includes a mechanical throttle control/governor.

The MAP sensor 540 may be positioned to acquire pressure data indicative of a pressure within the intake manifold of the engine 10. The intake air temperature sensor 550 may be positioned to acquire temperature data indicative of a temperature of the air entering the engine 10. The crankshaft speed and position sensor 570 may be positioned to acquire speed data indicative of a speed of the engine 10. The controller 122 may be configured to receive the pressure data, the temperature data, and/or the engine speed data. According to an exemplary embodiment, the controller 122 is configured to interpret the pressure data, the temperature data, and/or the speed data to determine a density of the air, determine an air mass flow rate, approximate a load on the engine 10, and/or control operation of the pumping assembly 192 (e.g., a current provided to the coil 176, etc.) to inject a proper amount of fuel for optimum combustion.

The crankshaft speed and position sensor 570 may be positioned to acquire position data indicative of a position (e.g., an angular position, a crank angle, etc.) of a crankshaft to the engine 10. In some embodiments, the crankshaft speed and position sensor 570 is configured to additionally acquire the speed data indicative of a speed of the engine 10 (e.g., the rotational speed of the crankshaft, etc.). In one embodiment, the crankshaft speed and position sensor 570 is and/or includes a gear having a plurality of teeth and a hall effect sensor and/or a variable reluctance sensor. The controller 122 may be configured to receive and interpret the position data to determine how fast the engine 10 is spinning (e.g., revolutions-per-minute (RPMs), etc.) and/or where in the combustion cycle the engine 10 is currently operating (e.g., an intake stroke, a compression stroke, a power stroke, an exhaust stroke, the position of the piston 14 within the cylinder 12, etc.).

The ignition coil 520 may be configured to up-convert a low voltage input provided by the power source 580 to a high voltage output to facilitate creating an electric spark in a spark plug of the engine 10 to ignite the fuel-air mixture provided by the FDI unit 110 and the throttle body 104 within the combustion chamber of the engine 10. The controller 122 may be configured to control the voltage input received by the ignition coil 520 from the power source 580, the voltage output from the ignition coil 520 to the spark plug, and/or the timing at which the spark is generated.

The power source 580 may be configured to power various components of the engine 10 and/or the control system 500. By way of example, the power source 580 may power the coil 176, the ignition coil 520, ETC actuator 124, the MAP sensor 540, the intake air temperature sensor 550, engine temperature sensor 555, throttle position sensor 565, and/or the crankshaft speed and position sensor 570. The power source 580 may additionally or alternatively be configured to be used to start the engine 10. In various embodiments, the power source 580 can include a battery, capacitor, and/or alternator output.

According to some embodiments, the EFI module 103 includes the throttle body 104, the FDI unit 110, the throttle plate 237, and the controller 122 with the throttle actuator 124 included on the controller's printed circuit board. In some embodiments, the MAP sensor 540, the temperature sensor 550, the crankshaft speed and position sensor 570 and/or other sensors are integrated with the controller 122 or included on the controller's printed circuit board. In some embodiments, the ignition coil 520 is included on the controller's printed circuit board.

In embodiments of a multi-cylinder engine (e.g., a V-twin engine), multiple EFI modules 103 may be used with one EFI module 103 associated with each cylinder. For example, a V-twin engine may use two EFI modules 103 with each connected to a different branch of an intake manifold that provides cleaned air to both cylinders. Each branch of the intake manifold may further include a throat similar to the throat of the throttle body 104.

During operation of FDI unit 110, Applicant has found that the EFI module 103 draws an average electrical current of about 1.5 Amps with the current drawn by an operational EFI module 103 having a generally saw tooth shape with peak currents of about 1.7 Amps and valley currents of about 1.3 Amps. This peak current of about 1.7 Amps can be generated with a pull-start mechanism, which allows an engine manufacture to provide an electronic fuel injection option without also requiring an electric start option, thereby reducing the costs of providing an electronic fuel injection option and allowing the EFI module 103 to function as a replacement for the carburetor of a carbureted engine with a pull-start mechanism. The FDI unit 110 only needs to be in operation (i.e., drawing electrical current) during an injection event, leaving the FDI unit 110 off (i.e., not drawing electrical current) during the majority of strokes of the piston of the cylinder (e.g., during operation of engine 10) to which the EFI module 103 provides the fuel-air mixture. A conventional EFI system (i.e., the not the EFI modules described herein), typically requires a fuel pump that operates continuously and draws greater than 1 Amp of current (e.g., 2 Amps) during its operation, which is continuous while the engine is in operation. The EFI module 103 is gravity fed from the fuel tank 102 and the FDI unit 110 only draws an electrical current while in operation. This results in the EFI module 103 requiring an average electrical current of less than 1 Amp during operation of the EFI module 103, which provides a significant reduction in the electrical current needed to operate the EFI module 103 than a conventional EFI system. An engine using the EFI module 103 does not require a fuel pump, thereby reducing costs relative to a conventional EFI system.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

Unless described differently above, the terms "coupled," "connected," and the like, as used herein, mean the joining of two members directly or indirectly to one another. Such joining may be stationary (e.g., permanent) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the elements of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed is:

1. An electronic fuel injection module, comprising:

a throttle body, comprising:

a throat extending between an inlet port and an outlet port; and a fuel delivery injector unit, comprising:

a cavity extending along a central longitudinal axis;

a fuel inlet configured to receive fuel and fluidly coupled to the cavity to direct fuel into the cavity;

a magnetic assembly including a magnet, a pole, and a hollow sleeve, wherein the magnet and the pole are secured to the sleeve, and wherein the magnetic assembly is fixedly positioned within the cavity;

a pumping assembly including a bobbin and a piston, wherein the bobbin includes a coil configured to be coupled to an electrical power supply, wherein the bobbin is configured to move the pumping assembly within the cavity in response to interaction between a magnetic field created by energizing the coil and the magnetic assembly, and wherein the piston is coupled to the bobbin and configured to move within the sleeve;

a spring coupled to the pumping assembly to bias the pumping assembly to a home position;

a valve seat located at one end of the piston;

a valve configured to selectively engage the valve seat in response to movement of the piston within the sleeve, wherein the valve allows fuel to flow into a pressure chamber when open and prevent fuel flow into the pressure chamber when closed; and an out valve positioned between the pressure chamber and an outlet passage, wherein the out valve allows fuel to flow from the pressure chamber into the outlet passage when open and prevent fuel flow from the pressure chamber into the outlet passage when closed, wherein the outlet passage is in fluid communication with the throat and configured to provide fuel to the throat.

2. The electronic fuel injection module of claim 1, wherein the throttle body further comprises:

a frame defining the cavity; and a cover coupled to the frame, the cover including the fuel inlet;

wherein, with the fuel delivery injector unit in a normal operating position, the fuel inlet is located near a bottom portion of the fuel delivery injector unit and the outlet passage is located near a top portion of the fuel delivery injector unit.

3. The electronic fuel injection module of claim 2, wherein the throat is defined in a throttle body housing and the frame of the fuel delivery injector unit is integrally formed with the throttle body housing to form a single unitary component.

4. The electronic fuel injection module of claim 1, further comprising:

an electronic controller configured to control operation of the fuel delivery inj ector unit;

wherein the throttle body further comprises a circuitry compartment and the electronic controller is located within the circuitry compartment.

5. The electronic fuel injection module of claim 1, further comprising:

a vent passage in fluid communication with the cavity and configured to vent fuel vapor and/or air from the fuel delivery injector unit.

6. The electronic fuel injection module of claim 1, further comprising:

the electrical power supply;

wherein the spring is electrically coupled to the coil and the electrical power supply and configured to conduct an electrical current from the electrical power supply to the coil.

7. The electronic fuel injection module of claim 6, wherein the spring is one of a plurality of springs, with each spring coupled to the pumping assembly to bias the pumping assembly to the home position and each spring electrically coupled to the coil and the electrical power supply and configured to conduct the electrical current from the electrical power supply to the coil.

8. A small air-cooled engine, comprising:

a cylinder including a cylinder head and cylinder intake port;

a piston configured to reciprocate within the cylinder;

a crankshaft configured to rotate in response to reciprocation of the piston;

a fuel tank configured to store a liquid fuel;

an air cleaner configured to filter air for combustion;

an electronic fuel injection module, comprising:

a throttle body, comprising:

a throat extending between an inlet port and an outlet port, wherein the inlet port is fluidly coupled to the air cleaner to receive filtered air; and a fuel delivery injector unit, comprising:

a cavity extending along a central longitudinal axis;

a fuel inlet configured to receive fuel and fluidly coupled to the cavity to direct fuel into the cavity;

a magnetic assembly including a magnet, a pole, and a hollow sleeve, wherein the magnet and the pole are secured to the sleeve, and wherein the magnetic assembly is fixedly positioned within the cavity;

a pumping assembly including a bobbin and a piston, wherein the bobbin includes a coil configured to be coupled to an electrical power supply, wherein the bobbin is configured to move the pumping assembly within the cavity in response to interaction between a magnetic field created by energizing the coil and the magnetic assembly, and wherein the piston is coupled to the bobbin and configured to move within the sleeve;

a spring coupled to the pumping assembly to bias the pumping assembly to a home position;

a valve seat located at one end of the piston;

a valve configured to selectively engage the valve seat in response to movement of the piston within the sleeve, wherein the valve allows fuel to flow into a pressure chamber when open and prevent fuel flow into the pressure chamber when closed; and an out valve positioned between the pressure chamber and an outlet passage, wherein the out valve allows fuel to flow from the pressure chamber into the outlet passage when open and prevent fuel flow from the pressure chamber into the outlet passage when closed, wherein the fuel inlet is fluidly coupled to the fuel tank, wherein the fuel inlet is positioned below the fuel tank so that liquid fuel is delivered to the fuel inlet via gravity, wherein the fuel inlet is located near a bottom portion of the fuel delivery injector unit and the outlet passage is located near a top portion of the fuel delivery injector unit, and wherein the outlet passage is fluidly coupled to the throat to provide fuel to mix with the filtered air;

wherein the outlet port is fluidly coupled to the cylinder intake port to provide a fuel-air mixture for combustion in the cylinder.

9. The small air-cooled engine of claim 8, wherein the fuel delivery injector unit is a separate component from the throttle body.

10. The small air-cooled engine of claim 8, wherein the outlet of the throttle body is directly coupled to the cylinder head to fluidly couple the outlet port to the cylinder intake port.

11. The small air-cooled engine of claim 8, further comprising a fitting, wherein the outlet of the throttle body is coupled to the cylinder head by the fitting to fluidly couple the outlet port to the cylinder intake port.

12. The small air-cooled engine of claim 8, wherein a fuel pump is not included.

13. The small air-cooled engine of claim 8, wherein the electronic fuel injection module comprises the electronic fuel injection module as recited in any of claims 2-6.

14. The small air-cooled engine of claim 8, wherein the electronic fuel injector module is configured to use an average electrical current of less than 1 Amp during operation of the engine.

15. The small air-cooled engine of claim 8, wherein the electronic fuel injector module is configured to use an average electrical current of about 1.5 Amps during an injection event of the fuel delivery injector unit.

* * * * *